US010946437B2

(12) United States Patent
Wagstaff et al.

(10) Patent No.: US 10,946,437 B2
(45) Date of Patent: Mar. 16, 2021

(54) CAST METAL PRODUCTS WITH HIGH GRAIN CIRCULARITY

(71) Applicant: NOVELIS INC., Atlanta, GA (US)

(72) Inventors: Samuel Robert Wagstaff, Marietta, GA (US); Kathleen Anna Bennett, Spokane Valley, WA (US); Elli Taylor Tindall, Coeur D'Alene, ID (US)

(73) Assignee: NOVELIS INC., Atlanta, GA (US)

( * ) Notice: Subject to any disclaimer, the term of this patent is extended or adjusted under 35 U.S.C. 154(b) by 0 days.

(21) Appl. No.: 16/788,981

(22) Filed: Feb. 12, 2020

(65) Prior Publication Data

US 2020/0254512 A1 Aug. 13, 2020

Related U.S. Application Data

(60) Provisional application No. 62/804,844, filed on Feb. 13, 2019.

(51) Int. Cl.

| | |
|---|---|
| ***B22D 11/00*** | (2006.01) |
| ***B22D 11/103*** | (2006.01) |
| ***B22D 11/114*** | (2006.01) |

(52) U.S. Cl.

CPC ..... *B22D 11/003* (2013.01); *B22D 11/103* (2013.01); *B22D 11/114* (2013.01)

(58) Field of Classification Search

CPC ... B22C 11/003; B22C 11/103; B22C 11/114; B22D 11/003; B22D 11/103; B22D 11/114; B22D 11/00; B22D 11/10; B22D 11/115–116

See application file for complete search history.

(56) References Cited

U.S. PATENT DOCUMENTS

| | | | |
|---|---|---|---|
| 6,672,368 | B2 | 1/2004 | Unal |
| 8,927,113 | B2 | 1/2015 | Anderson et al. |
| 8,956,472 | B2 | 2/2015 | Unal et al. |
| 9,528,174 | B2 | 12/2016 | Sawtell et al. |
| 9,587,298 | B2 | 3/2017 | Lin et al. |
| 9,926,620 | B2 | 3/2018 | Kamat et al. |
| 2007/0095499 | A1 | 5/2007 | Tomes, Jr. et al. |

(Continued)

FOREIGN PATENT DOCUMENTS

| | | | |
|---|---|---|---|
| CN | 106925730 | A | 7/2017 |
| CN | 106944598 | A | 7/2017 |

(Continued)

OTHER PUBLICATIONS

Katgerman, "A Mathematical Model for Hot Cracking of Aluminum Alloys During D.C. Casting," Journal of Metals, Feb. 1982, pp. 46-49, The Minerals, Metals & Materials Society, Pittsburgh, PA.

(Continued)

*Primary Examiner* — Kevin P Kerns
*Assistant Examiner* — Steven S Ha
(74) *Attorney, Agent, or Firm* — Kilpatrick Townsend & Stockton LLP

(57) ABSTRACT

Systems and methods for making aluminum alloy products are described including those that decrease the tendency for hot tearing or shrinkage porosity to occur during casting by introducing forced convection during the casting process. The forced convection may result in formation of high circularity grains during the solidification process, thereby increasing the permeability of the liquid aluminum alloy and decreasing the tendency for hot tearing or shrinkage porosity to occur.

20 Claims, 9 Drawing Sheets

(56) References Cited

U.S. PATENT DOCUMENTS

| | | | |
|---|---|---|---|
| 2014/0366997 | A1 | 12/2014 | Kamat et al. |
| 2014/0366998 | A1 | 12/2014 | Kamat et al. |
| 2015/0071816 | A1 | 3/2015 | Unal et al. |
| 2015/0336168 | A1 | 11/2015 | Wagstaff et al. |
| 2016/0138400 | A1 | 5/2016 | Karabin et al. |
| 2016/0215370 | A1 | 7/2016 | Newman et al. |
| 2017/0292174 | A1 | 10/2017 | Karabin et al. |
| 2018/0171440 | A1 | 6/2018 | Unal et al. |

FOREIGN PATENT DOCUMENTS

| | | | |
|---|---|---|---|
| FR | 2761624 | A1 | 10/1998 |
| JP | 6419742 | B2 | 11/2018 |

OTHER PUBLICATIONS

Brabazon, et al., "Mechanical Stir Casting of Aluminium Alloys From the Mushy State: Process, Microstructure and Mechanical Properties", Materials Science and Engineering A, Mar. 31, 2002, pp. 370-381, vol. 326, No. 2, Elsevier Science B.V.

The Aluminum Association, Inc., "International Alloy Designations and Chemical Composition Limits for Wrought Aluminum and Wrought Aluminum Alloys," Registration Record Series: Teal Sheets, Feb. 1, 2009, 35 pages, The Aluminum Association, Inc.

International Patent Application No. PCT/US2020/017921 , International Search Report and Written Opinion, dated Apr. 28, 2020, 18 pages.

CAST METAL PRODUCTS WITH HIGH GRAIN CIRCULARITY

CROSS-REFERENCE TO RELATED APPLICATIONS

This application claims the benefit of and priority to U.S. Provisional Patent Application No. 62/804,844, filed Feb. 13, 2019, entitled "CAST METAL PRODUCTS WITH HIGH GRAIN CIRCULARITY," which is incorporated by reference herein in its entirety for all purposes.

FIELD

The present disclosure relates to metallurgy generally and more specifically to processes for reducing hot cracking during casting.

BACKGROUND

During ingot casting, hot cracking or hot tearing can occur during the solidification process. This can occur because when aluminum alloys solidify there is an accompanying volume contraction (e.g., about 6%). This means that as aluminum grains solidify they begin to contract at a certain point, which then allows additional liquid to be drawn in between the interstitial spaces. If there is insufficient head pressure to force the liquid between the grains, then shrinkage porosity or potentially hot tearing can occur.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

In an aspect, methods for making aluminum products are described. The described aluminum products may be free or substantially free of hot cracking or associated defects. An example method of this aspect comprises feeding an aluminum alloy in a molten state into a casting cavity to form an intermediate product, wherein the intermediate product comprises a first zone having a first temperature below a liquidus temperature of the aluminum alloy and above a coherency temperature of the aluminum alloy; a second zone adjacent to the first zone, the second zone having a second temperature below or about the coherency temperature of the aluminum alloy and above a solidus temperature of the aluminum alloy; and a third zone adjacent to the second zone, the third zone having a third temperature below or about the solidus temperature; and forcing convection in at least the first zone to limit a temperature variation across the first zone; wherein grains of the third zone of the intermediate product have an average circularity from 0.5 to 1. In embodiments, methods of this aspect may comprise cooling at least the third zone, such as by application of cooling water to a solid exterior surface of the intermediate product. In embodiments, the third zone of the intermediate product is separated from the first zone of the intermediate product. In embodiments, the second zone of the intermediate product is disposed between the first zone of the intermediate product and the third zone. In embodiments, the second zone of the intermediate product is disposed vertically between the first zone of the intermediate product the third zone. In embodiments, the second zone of the intermediate product is disposed horizontally between the first zone of the intermediate product the third zone. Any suitable casting technique may be used in the methods described herein. For example, in some embodiments, methods of this aspect comprise or correspond to direct chill casting methods. Optionally, methods of this aspect comprise or correspond to continuous casting methods.

By forcing convection during casting, a temperature gradient across a liquid zone of a casting can be reduced to below a threshold amount, which may limit the growth of highly dendritic grains. In turn, the tendency for hot cracks to develop during solidification and cooling can be limited, which can improve casting recovery. In some embodiments, the average circularity of the grains of the third zone of the intermediate product, which may correspond to a solid aluminum product, ranges from 0.6 to 1. In some cases, the third zone contains no defects due to hot cracking.

In some examples, the temperature variation across the first zone may be less than or about 10° C. For example, the temperature variation may be less than or about 1° C., less than or about 2° C., less than or about 3° C., less than or about 4° C., less than or about 5° C., less than or about 6° C., less than or about 7° C., less than or about 8° C., less than or about 9° C. To achieve flexibility in casting, however, the temperature variation across the first zone may be controllable, such as by controlling one or more of a casting rate, a cooling rate, or a magnitude or amount of the forced convection, which may allow control over properties of the resultant cast product. In some cases, the temperature variation across the first zone may be up to 20° C. or up to 30° C., for example. In some cases, the temperature variation across the first zone may be determined as a fraction of a liquidus temperature of the aluminum alloy. For example, in some embodiments, the temperature variation across the first zone may be less than 2% of the liquidus temperature of the aluminum alloy. As used herein, temperature variation expressed as a percent or fraction of a liquidus temperature may refer to the ratio of the temperature variation (e.g., in ° C.) to the liquidus temperature (e.g., in ° C.). In some cases, the first temperature is uniform within the first zone of the intermediate product. Optionally, the first temperature ranges from 10° C. below the liquidus temperature of the aluminum alloy to 1° C. below the liquidus temperature of the aluminum alloy. Optionally, the first temperature may be any value from 540° C. to 660° C. In some cases, the first temperature may vary within a small temperature window, such as ±1° C., ±2° C., ±5° C., or ±10° C. Optionally, a method of this aspect further comprises adjusting a rate or amount of the forced convection in at least the first zone to achieve a target material property in the third zone. As examples, the target material property may be one or more of an average grain size in the third zone or the average circularity of grains in the third zone. Optionally, a method of this aspect comprises adjusting a rate or amount of the forced convection in at least the first zone to achieve a target value of the first temperature.

During casting, the various zones may exhibit different grain sizes within the zones. For example, in the first zone, the grains may be very small. For example, the first zone of the intermediate product may comprise seed grains of the aluminum alloy having a first average size, such as a first average size of from 10 μm to 50 μm. Example first average sizes may be from 10 μm to 15 μm, from 10 μm to 20 μm, from 10 μm to 25 μm, from 10 μm to 30 μm, from 10 μm to 35 μm, from 10 μm to 40 μm, from 10 μm to 45 μm, from 15 μm to 20 μm, from 15 μm to from 15 μm to 30 μm, from 15 μm to 35 μm, from 15 μm to 40 μm, from 15 μm to 45 μm, from 15 μm to 50 μm, from 20 μm to 25 μm, from 20 μm to 30 μm, from 20 μm to 35 μm, from 20 μm to 40 μm, from 20 μm to 45 μm, from 20 μm to 50 μm, from 25 μm to 30 μm, from 25 μm to 35 μm, from 25 μm to 40 μm, from 25 μm to 45 μm, from 25 μm to 50 μm, from 30 μm to 35 μm, from 30 μm to 40 μm, from 30 μm to 45 μm, from 30 μm to 50 μm, from 35 μm to 40 μm, from 35 μm to 45 μm, from 35 μm to 50 μm, from 40 μm to 45 μm, from 40 μm to 50 μm, or from 45 μm to 50 μm. In embodiments, the second zone of the intermediate product comprises grains of the aluminum alloy having a second average size, such as a second average size that is greater than the first average size. In embodiments, the third zone of the intermediate product comprises grains of the aluminum alloy having a third average size, such as a third average size that is greater than the second average size. Optionally, the third average size may be from 100 μm to 150 μm. Example third average sizes may be from 100 μm to 105 μm, from 100 μm to 110 μm, from 100 μm to 115 μm, from 100 μm to 120 μm, from 100 μm to 125 μm, from 100 μm to 130 μm, from 100 μm to 135 μm, from 100 μm to 140 μm, from 100 μm to 145 μm, from 100 μm to 150 μm, from 105 μm to 110 μm, from 105 μm to 115 μm, from 105 μm to 120 μm, from 105 μm to 125 μm, from 105 μm to 130 μm, from 105 μm to 135 μm, from 105 μm to 140 μm, from 105 μm to 145 μm, from 105 μm to 150 μm, from 110 μm to 115 μm, from 110 μm to 120 μm, from 110 μm to 125 μm, from 110 μm to 130 μm, from 110 μm to 135 μm, from 110 μm to 140 μm, from 110 μm to 145 μm, from 110 μm to 150 μm, from 115 μm to 120 μm, from 115 μm to 125 μm, from 115 μm to 130 μm, from 115 μm to 135 μm, from 115 μm to 140 μm, from 115 μm to 145 μm, from 115 μm to 150 μm, from 120 μm to 125 μm, from 120 μm to 130 μm, from 120 μm to 135 μm, from 120 μm to 140 μm, from 120 μm to 145 μm, from 120 μm to 150 μm, from 125 μm to 130 μm, from 125 μm to 135 μm, from 125 μm to 140 μm, from 125 μm to 145 μm, from 125 μm to 150 μm, from 130 μm to 135 μm, from 130 μm to 140 μm, from 130 μm to 145 μm, from 130 μm to 150 μm, from 135 μm to 140 μm, from 135 μm to 145 μm, from 135 μm to 150 μm, from 140 μm to 145 μm, from 140 μm to 150 μm, or from 145 μm to 150 μm.

Optionally, a method of this aspect may further comprise feeding the molten aluminum alloy into the second zone of the intermediate product to fill interstitial spaces among grains of the aluminum alloy in the second zone of the intermediate product. Such feeding may occur during the casting process. Feeding may comprise, for example, application of a pressure to the first zone to force the molten aluminum alloy within the first zone or the second zone into the interstitial spaces. In some cases, the pressure may be applied by gravity. In some cases, a reduced pressure may be needed to fill the interstitial spaces, such as compared to a pressure needed to fill interstitial spaces during casting without use of forced convection.

Any suitable technique may be employed for forcing convection. For example, in one embodiment, forcing convection comprises stirring the first zone of the intermediate product. Optionally, the first zone of the intermediate product is stirred by an ultrasonic stirrer. Optionally, the first zone of the intermediate product is stirred by a mechanical stirrer. Example mechanical stirrers include, but are not limited to, a paddle or propeller, which may be rotated or moved using any suitable means or technique. Optionally, the paddle or propeller comprises at least one of aluminum oxide, aluminum nitride, or graphite. Optionally, the paddle or propeller comprises a refractory material or is coated with a refractory material.

Cast aluminum alloy products formed using the methods described herein are also provided. Example cast products include ingots, continuously cast slabs, or rolled products obtained therefrom.

Other objects and advantages will be apparent from the following detailed description of non-limiting examples.

BRIEF DESCRIPTION OF THE FIGURES

The specification makes reference to the following appended figures, in which use of like reference numerals in different figures is intended to illustrate like or analogous components.

DETAILED DESCRIPTION

Figure 1:
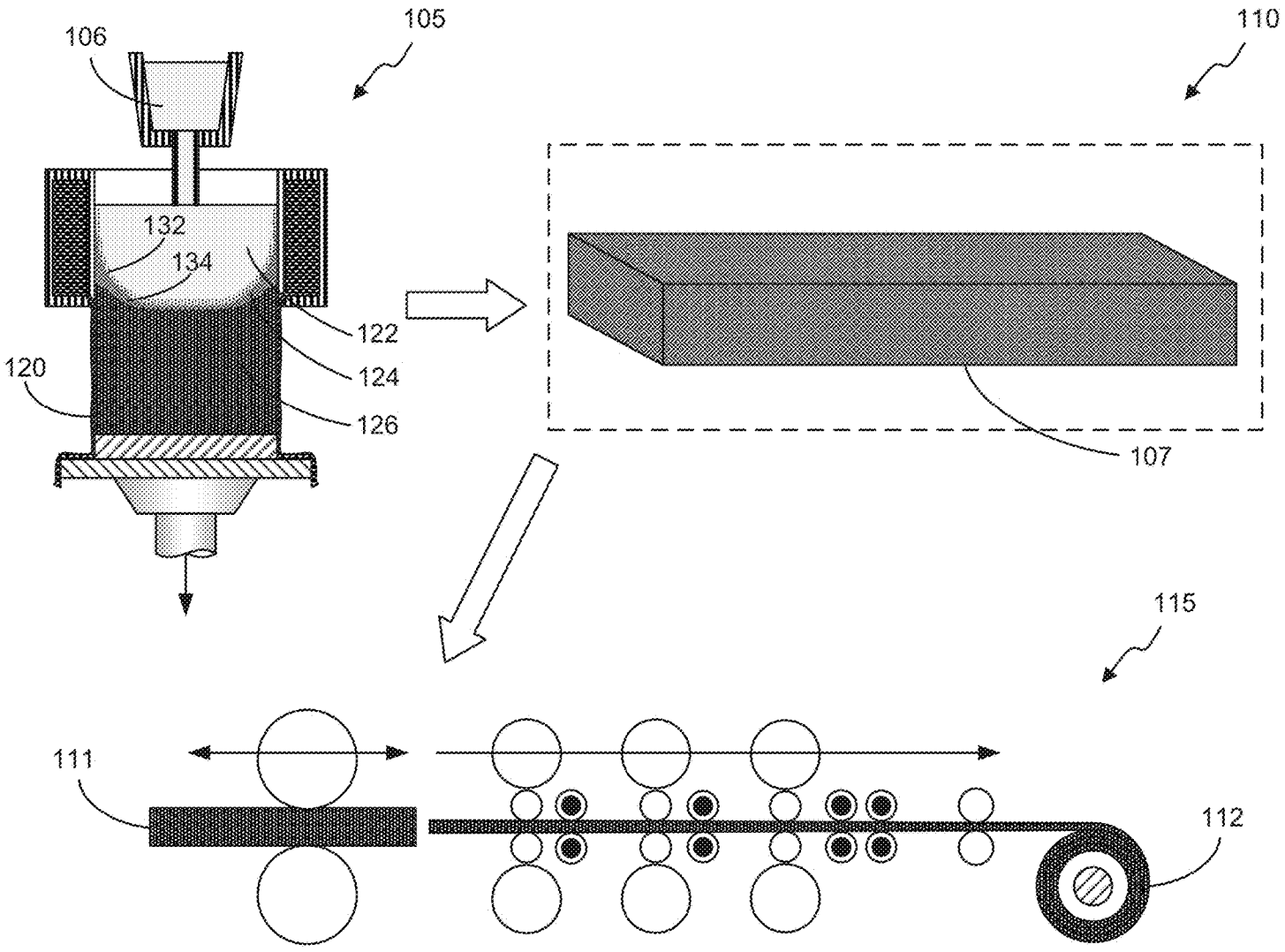
FIG. 1 Prior Art
FIG. 1 schematically illustrates a method of making an aluminum alloy product.

Described herein are systems and methods for making aluminum alloy products. The systems and methods described herein decrease the tendency for hot tearing or shrinkage porosity to occur during casting by introducing forced convection during the casting process. By using forced convection, a zone of a mixture of liquid aluminum alloy and seed grains may be created. The forced convection may limit the temperature drop inside this mixture zone and substantially equalize the temperature within the mixture zone. The forced convection may also improve the circularity or sphericity of the grains formed during the solidification process, thereby increasing the permeability of the liquid aluminum alloy and decreasing the tendency for hot tearing or shrinkage porosity to occur.

Definitions and Descriptions

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, a plate generally has a thickness of greater than about 15 mm. For example, a plate may refer to an aluminum product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a shate (also referred to as a sheet plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to an aluminum product having a thickness of less than about 4 mm. For example, a sheet may have a thickness of less than about 4 mm, less than about 3 mm, less than about 2 mm, less than about 1 mm, less than about 0.5 mm, or less than about 0.3 mm (e.g., about 0.2 mm).

Reference may be made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. An Hxx condition or temper, also referred to herein as an H temper, refers to a non-heat treatable aluminum alloy after cold rolling with or without thermal treatment (e.g., annealing). Suitable H tempers include HX1, HX2, HX3 HX4, HX5, HX6, HX7, HX8, or HX9 tempers. A T1 condition or temper refers to an aluminum alloy cooled from hot working and naturally aged (e.g., at room temperature). A T2 condition or temper refers to an aluminum alloy cooled from hot working, cold worked and naturally aged. A T3 condition or temper refers to an aluminum alloy solution heat treated, cold worked, and naturally aged. A T4 condition or temper refers to an aluminum alloy solution heat treated and naturally aged. A T5 condition or temper refers to an aluminum alloy cooled from hot working and artificially aged (at elevated temperatures). A T6 condition or temper refers to an aluminum alloy solution heat treated and artificially aged. A T7 condition or temper refers to an aluminum alloy solution heat treated and artificially overaged. A T8x condition or temper refers to an aluminum alloy solution heat treated, cold worked, and artificially aged. A T9 condition or temper refers to an aluminum alloy solution heat treated, artificially aged, and cold worked. A W condition or temper refers to an aluminum alloy after solution heat treatment.

As used herein, terms such as "cast metal product," "cast product," "cast aluminum alloy product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C. As used herein, the meaning of "ambient conditions" can include temperatures of about room temperature, relative humidity of from about 20% to about 100%, and barometric pressure of from about 975 millibar (mbar) to about 1050 mbar. For example, relative humidity can be about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, about 50%, about 51%, about 52%, about 53%, about 54%, about 55%, about 56%, about 57%, about 58%, about 59%, about 60%, about 61%, about 62%, about 63%, about 64%, about 65%, about 66%, about 67%, about 68%, about 69%, about 70%, about 71%, about 72%, about 73%, about 74%, about 75%, about 76%, about 77%, about 78%, about 79%, about 80%, about 81%, about 82%, about 83%, about 84%, about 85%, about 86%, about 87%, about 88%, about 89%, about 90%, about 91%, about 92%, about 93%, about 94%, about 95%, about 96%, about 97%, about 98%, about 99%, about 100%, or anywhere in between. For example, barometric pressure can be about 975 mbar, about 980 mbar, about 985 mbar, about 990 mbar, about 995 mbar, about 1000 mbar, about 1005 mbar, about 1010 mbar, about 1015 mbar, about 1020 mbar, about 1025 mbar, about 1030 mbar, about 1035 mbar, about 1040 mbar, about 1045 mbar, about 1050 mbar, or anywhere in between.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10. Unless stated otherwise, the expression "up to" when referring to the compositional amount of an element means that element is optional and may include a zero percent composition of that particular element. Unless stated otherwise, all compositional percentages are in weight percent (wt. %).

As used herein, the meaning of "a," "an," and "the" includes singular and plural references unless the context clearly dictates otherwise.

Methods of Producing Aluminum Alloy Products

The aluminum alloy products described herein can be cast using any suitable casting method. As a few non-limiting examples, the casting process can include a direct chill (DC) casting process or a continuous casting (CC) process. A continuous casting system used in a continuous casting process can include a pair of moving opposed casting surfaces (e.g., moving opposed belts, rolls or blocks), a casting cavity between the pair of moving opposed casting surfaces, and a molten metal injector. The molten metal injector can have an end opening from which molten metal can exit the molten metal injector and be injected into the casting cavity.

In some examples, the cast product can include a clad layer attached to a core layer to form a cladded product by any means known to persons of ordinary skill in the art. For example, a clad layer can be attached to a core layer by direct chill co-casting (i.e., fusion casting) as described in, for example, U.S. Pat. Nos. 7,748,434 and 8,927,113, both of which are hereby incorporated by reference in their entireties; by hot and cold rolling a composite cast ingot as described in U.S. Pat. No. 7,472,740, which is hereby incorporated by reference in its entirety; or by roll bonding to achieve the required metallurgical bonding between the core and the cladding. The initial dimensions and final dimensions of the clad aluminum alloy products described herein can be determined by the desired properties of the overall final product.

Roll bonding processes can be carried out using any suitable technique. For example, the roll-bonding process can include both hot rolling and cold rolling. Further, the roll bonding process can be a one-step process or a multi-step process in which the material is gauged down during successive rolling steps. Separate rolling steps can optionally be separated by other processing steps, including, for example, annealing steps, cleaning steps, heating steps, cooling steps, and the like.

The cast ingot or other cast product can undergo various processing steps by any suitable means. Optionally, the processing steps can be used to prepare sheets. Such processing steps include, but are not limited to, homogenization, hot rolling, cold rolling, solution heat treatment, and an optional pre-aging step.

In a homogenization step, the cast product may be heated to a temperature ranging from about 400° C. to about 500° C. For example, the cast product can be heated to a temperature of about 400° C., about 410° C., about 420° C., about 430° C., about 440° C., about 450° C., about 460° C., about 470° C., about 480° C., about 490° C., or about 500° C. The cast product may then be allowed to soak (i.e., held at the indicated temperature) for a period of time to form a homogenized product. In some examples, the total time for the homogenization step, including the heating and soaking phases, can be up to 24 hours. For example, the cast product can be heated up to 500° C. and soaked, for a total time of up to 18 hours for the homogenization step. Optionally, the cast product can be heated to below 490° C. and soaked, for a total time of greater than 18 hours for the homogenization step. In some cases, the homogenization step comprises multiple homogenization steps. In some non-limiting examples, the homogenization step includes heating the cast product to a first temperature for a first period of time followed by heating to a second temperature for a second period of time. For example, the cast product can be heated to about 465° C. for about 3.5 hours and then heated to about 480° C. for about 6 hours.

Following the homogenization step, a hot rolling step may be performed. Prior to the start of hot rolling, the homogenized product can be allowed to cool to a temperature between 300° C. to 450° C. For example, the homogenized product can be allowed to cool to a temperature of between 325° C. to 425° C. or from 350° C. to 400° C. If a homogenized product is allowed to cool, prior to hot rolling, to a temperature lower than that suitable for hot rolling, it may be subjected to a heating process to bring it up to a temperature suitable for hot rolling. The homogenized product may be hot rolled at a temperature between 300° C. to 450° C. to form a hot rolled plate, a hot rolled shate, or a hot rolled sheet having a gauge between 3 mm and 200 mm (e.g., 3 mm, 4 mm, 5 mm, 6 mm, 7 mm, 8 mm, 9 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 110 mm, 120 mm, 130 mm, 140 mm, 150 mm, 160 mm, 170 mm, 180 mm, 190 mm, 200 mm, or anywhere in between).

Optionally, the cast product can be a continuously cast product that can be allowed to cool to a temperature between 300° C. to 450° C. For example, the continuously cast product can be allowed to cool to a temperature of between 325° C. to 425° C. or from 350° C. to 400° C. Again, if cooled to a temperature lower than that suitable for hot rolling, the continuously cast product may be reheated. The continuously cast product may be hot rolled at a temperature between 300° C. to 450° C. to form a hot rolled plate, a hot rolled shate, or a hot rolled sheet having a gauge between 3 mm and 200 mm (e.g., 3 mm, 4 mm, 5 mm, 6 mm, 7 mm, 8 mm, 9 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 110 mm, 120 mm, 130 mm, 140 mm, 150 mm, 160 mm, 170 mm, 180 mm, 190 mm, 200 mm, or anywhere in between). During hot rolling, temperatures and other operating parameters can be controlled so that the temperature of the hot rolled intermediate product upon exit from the hot rolling mill is no more than 470° C., no more than 450° C., no more than 440° C., or no more than 430° C.

The homogenized or hot-rolled product can be cold rolled using cold rolling mills and technology into a thinner product, such as a cold rolled sheet. The cold rolled product can have a gauge between about 0.5 to 10 mm, e.g., between about 0.7 to 6.5 mm. Optionally, the cold rolled sheet can have a gauge of 0.5 mm, 1.0 mm, 1.5 mm, 2.0 mm, 2.5 mm, 3.0 mm, 3.5 mm, 4.0 mm, 4.5 mm, 5.0 mm, 5.5 mm, 6.0 mm, 6.5 mm, 7.0 mm, 7.5 mm, 8.0 mm, 8.5 mm, 9.0 mm, 9.5 mm, or 10.0 mm. The cold rolling can be performed to result in a final gauge thickness that represents a gauge reduction of up to 85% (e.g., up to 10%, up to 20%, up to 30%, up to 40%, up to 50%, up to 60%, up to 70%, up to 80%, or up to 85% reduction) as compared to a gauge thickness prior to cold rolling.

Subsequently, the rolled product can optionally undergo a solution heat treatment step. The solution heat treatment step can be any suitable treatment for the rolled product which results in solutionizing of soluble particles in the aluminum alloy. The rolled product can be heated to a peak metal temperature (PMT) of up to 590° C. (e.g., from 400° C. to 590° C.) and soaked for a period of time at the PMT. For example, the rolled product can be soaked at 480° C. for a soak time of up to 30 minutes (e.g., 0 seconds, 60 seconds, 75 seconds, 90 seconds, 5 minutes, 10 minutes, 20 minutes, 25 minutes, or 30 minutes). After heating and soaking, the rolled product is rapidly cooled (quenched) at rates greater than 200° C./s to a temperature between 500 and 200° C. In one example, a quench rate of above 200° C./second at temperatures between 450° C. and 200° C. may be used. Optionally, the cooling rates can be faster in other cases.

After quenching, the heat-treated product can optionally undergo a pre-aging treatment by reheating before coiling. The pre-aging treatment can be performed at a temperature of from about 70° C. to about 125° C. for a period of time of up to 6 hours. For example, the pre-aging treatment can be performed at a temperature of about 70° C., about 75° C., about 80° C., about 85° C., about 90° C., about 95° C., about 100° C., about 105° C., about 110° C., about 115° C., about 120° C., or about 125° C. Optionally, the pre-aging treatment can be performed for about 30 minutes, about 1 hour, about 2 hours, about 3 hours, about 4 hours, about 5 hours, or about 6 hours. The pre-aging treatment can be carried out by passing the product through a heating device, such as a device that emits radiant heat, convective heat, induction heat, infrared heat, or the like.

The cast products described herein can also be used to make products in the form of plates or other suitable products. For example, plates including cast products as described herein can be prepared by processing an ingot in a homogenization step or casting a product in a continuous caster followed by a hot rolling step. In the hot rolling step, the cast product can be hot rolled to a 200 mm thick gauge or less (e.g., from greater than about 15 mm to about 200 mm). For example, the cast product can be hot rolled to a plate having a final gauge thickness of greater than about 15 mm to about 175 mm, about 15 mm to about 150 mm, about 20 mm to about 125 mm, about 25 mm to about 100 mm, about 30 mm to about 75 mm, or about 35 mm to about 50 mm.

In embodiments, methods of producing metal and metal alloys, including aluminum, aluminum alloys, magnesium, magnesium alloys, magnesium composites, and steel, among others, and the resultant and treated metals and metal alloys are provided. In some examples, the metals for use in the methods described herein include aluminum alloys, for example, 1xxx series aluminum alloys, 2xxx series aluminum alloys, 3xxx series aluminum alloys, 4xxx series aluminum alloys, 5xxx series aluminum alloys, 6xxx series aluminum alloys, 7xxx series aluminum alloys, or 8xxx series aluminum alloys. In some examples, the materials for use in the methods described herein include non-ferrous materials, including aluminum, aluminum alloys, magnesium, magnesium-based materials, magnesium alloys, magnesium composites, titanium, titanium-based materials, titanium alloys, copper, copper-based materials, composites, sheets used in composites, or any other suitable metal, non-metal or combination of materials. Monolithic as well as non-monolithic, such as roll-bonded materials, cladded alloys, cladding layers, composite materials, such as but not limited to carbon fiber-containing materials, or various other materials are also useful with the methods described herein. In some examples, aluminum alloys containing iron are useful with the methods described herein.

By way of non-limiting example, exemplary 1xxx series aluminum alloys for use in the methods described herein can include AA1100, AA1100A, AA1200, AA1200A, AA1300, AA1110, AA1120, AA1230, AA1230A, AA1235, AA1435, AA1145, AA1345, AA1445, AA1150, AA1350, AA1350A, AA1450, AA1370, AA1275, AA1185, AA1285, AA1385, AA1188, AA1190, AA1290, AA1193, AA1198, or AA1199.

Non-limiting exemplary 2xxx series aluminum alloys for use in the methods described herein can include AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2024, AA2024A, AA2124, AA2224, AA2224A, AA2324, AA2424, AA2524, AA2624, AA2724, AA2824, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, or AA2199.

Non-limiting exemplary 3xxx series aluminum alloys for use in the methods described herein can include AA3002, AA3102, AA3003, AA3103, AA3103A, AA3103B, AA3203, AA3403, AA3004, AA3004A, AA3104, AA3204, AA3304, AA3005, AA3005A, AA3105, AA3105A, AA3105B, AA3007, AA3107, AA3207, AA3207A, AA3307, AA3009, AA3010, AA3110, AA3011, AA3012, AA3012A, AA3013, AA3014, AA3015, AA3016, AA3017, AA3019, AA3020, AA3021, AA3025, AA3026, AA3030, AA3130, or AA3065.

Non-limiting exemplary 4xxx series aluminum alloys for use in the methods described herein can include AA4004, AA4104, AA4006, AA4007, AA4008, AA4009, AA4010, AA4013, AA4014, AA4015, AA4015A, AA4115, AA4016, AA4017, AA4018, AA4019, AA4020, AA4021, AA4026, AA4032, AA4043, AA4043A, AA4143, AA4343, AA4643, AA4943, AA4044, AA4045, AA4145, AA4145A, AA4046, AA4047, AA4047A, or AA4147.

Non-limiting exemplary 5xxx series aluminum alloys for use as the aluminum alloy product can include AA5005, AA5005A, AA5205, AA5305, AA5505, AA5605, AA5006, AA5106, AA5010, AA5110, AA5110A, AA5210, AA5310, AA5016, AA5017, AA5018, AA5018A, AA5019, AA5019A, AA5119, AA5119A, AA5021, AA5022, AA5023, AA5024, AA5026, AA5027, AA5028, AA5040, AA5140, AA5041, AA5042, AA5043, AA5049, AA5149, AA5249, AA5349, AA5449, AA5449A, AA5050, AA5050A, AA5050C, AA5150, AA5051, AA5051A, AA5151, AA5251, AA5251A, AA5351, AA5451, AA5052, AA5252, AA5352, AA5154, AA5154A, AA5154B, AA5154C, AA5254, AA5354, AA5454, AA5554, AA5654, AA5654A, AA5754, AA5854, AA5954, AA5056, AA5356, AA5356A, AA5456, AA5456A, AA5456B, AA5556, AA5556A, AA5556B, AA5556C, AA5257, AA5457, AA5557, AA5657, AA5058, AA5059, AA5070, AA5180, AA5180A, AA5082, AA5182, AA5083, AA5183, AA5183A, AA5283, AA5283A, AA5283B, AA5383, AA5483, AA5086, AA5186, AA5087, AA5187, or AA5088.

Non-limiting exemplary 6xxx series aluminum alloys for use in the methods described herein can include AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, or AA6092.

Non-limiting exemplary 7xxx series aluminum alloys for use in the methods described herein can include AA7011, AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046, AA7046A, AA7003, AA7004, AA7005, AA7009, AA7010, AA7011, AA7012, AA7014, AA7016, AA7116, AA7122, AA7023, AA7026, AA7029, AA7129, AA7229, AA7032, AA7033, AA7034, AA7036, AA7136, AA7037, AA7040, AA7140, AA7041, AA7049, AA7049A, AA7149,7204, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, or AA7099.

Non-limiting exemplary 8xxx series aluminum alloys for use in the methods described herein can include AA8005, AA8006, AA8007, AA8008, AA8010, AA8011, AA8011A, AA8111, AA8211, AA8112, AA8014, AA8015, AA8016, AA8017, AA8018, AA8019, AA8021, AA8021A, AA8021B, AA8022, AA8023, AA8024, AA8025, AA8026, AA8030, AA8130, AA8040, AA8050, AA8150, AA8076, AA8076A, AA8176, AA8077, AA8177, AA8079, AA8090, AA8091, or AA8093.

The following description will serve to further illustrate the present invention without, at the same time, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

FIG. 1 provides an overview of a method of making an aluminum alloy product. The method of FIG. 1 begins at step 105 where molten aluminum alloy 106 is cast to form a cast aluminum alloy product 107, such as an ingot or other cast product. The cast aluminum alloy product 107 can be processed by any suitable means. Example processing steps include, but are not limited to, homogenization, hot rolling, cold rolling, annealing, solution heat treatment, pre-aging, etc. Some exemplary processing steps are shown in FIG. 1. At step 110, the cast aluminum alloy product 107 is homogenized to form a homogenized aluminum alloy product 111. At step 115, the homogenized aluminum alloy product 111 is subjected to one or more hot rolling passes and/or one or more cold rolling passes to form a rolled aluminum alloy product 112, which may correspond to an aluminum alloy article, such as an aluminum alloy plate, an aluminum alloy shate, or an aluminum alloy sheet that is coiled after rolling. Optionally, the rolled aluminum alloy product 112 is subjected to one or more forming or stamping processes to form an aluminum alloy article.

As noted above, the aluminum alloys described herein can be cast using any suitable casting method. As a few non-limiting examples, the casting process can include a direct chill (DC) casting process or a continuous casting (CC) process. For example, FIG. 1 depicts a schematic illustration of a DC casting process at 105. As also described above, a continuous casting system can include a pair of moving opposed casting surfaces (e.g., moving opposed belts, rolls or blocks), a casting cavity between the pair of moving opposed casting surfaces, and a molten metal injector. The molten metal injector can have an end opening from which molten metal can exit the molten metal injector and be injected into the casting cavity.

With further reference to FIG. 1, when the molten aluminum alloy 106 is fed into the casting cavity, a multi-zoned intermediate product 120 may be formed. The intermediate product 120 may include a liquid zone 122, a mushy zone 124 below the liquid zone 122, and a solid zone 126 below the mushy zone 124. The liquid zone 122 may include molten aluminum alloy, and thus the temperature of the liquid zone 122 may be above the liquidus temperature of the aluminum alloy. However, the temperature within the liquid zone 122 may vary and may gradually decrease from an upper region into which the molten aluminum alloy 106 may be fed to a lower region adjacent the mushy zone 124.

The mushy zone 124 may be a semi-solid zone where both a liquid phase and a solid phase of the aluminum alloy exists. Within the mushy zone 124, a solid phase of the aluminum alloy may begin to form as grains of aluminum alloy start to form and grow. Similar to the liquid zone 122, the temperature within the mushy zone 124 may also gradually decrease from one region to another region, such as from an upper region to a lower region in DC casting. As the grains initially form in the mushy zone 124, the grains may not touch each other. As the temperature gradually decreases and the grains grow in size, the grains may contact each other and form a continuous network. The temperature at which the grains begin to contact each other and form the continuous network may be referred to as a coherency temperature of the aluminum alloy. Accordingly, the mushy zone 124 may include two sub-zones or regions: a first region or an upper region 132, the temperature of which may be above the coherency temperature and within which the grains may not touch each other and flow easily, and a second region or a lower region 134, within which a continuous network of grains may be formed and the temperature may be below the coherency temperature and above the solidus temperature. In the lower region, due to the limited mobility of the grains and the accompanying volume contraction during solidification, shrinkage porosity or potentially hot tearing can result during solidification if there is insufficient head pressure to force liquid into the interstitial spaces between the grains and reduce a porosity character between grains.

Figure 2:
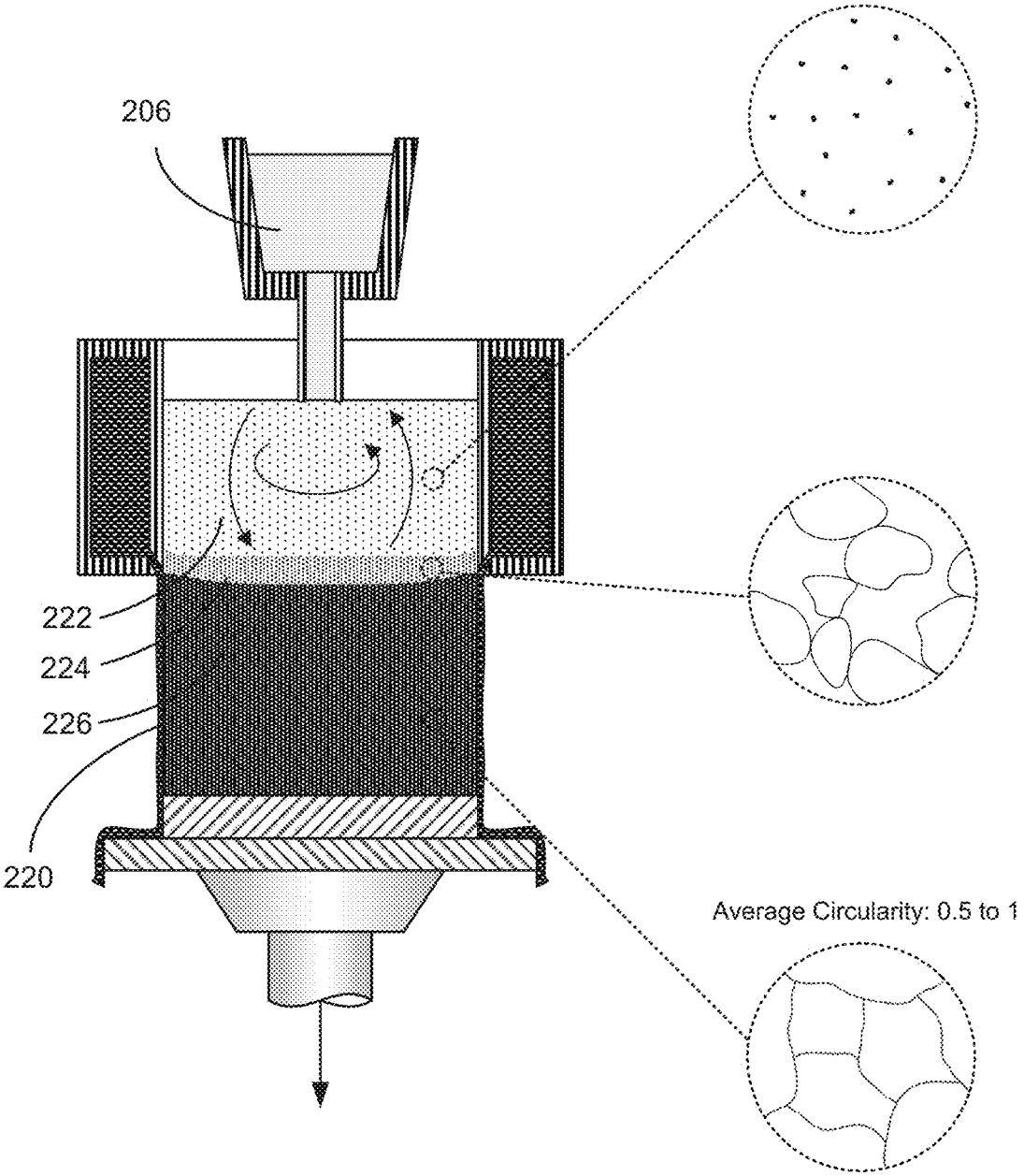
FIG. 2 schematically illustrates another method of making an aluminum alloy product.

FIG. 2 schematically illustrates a method of making an aluminum alloy product that may decrease the tendency for hot tearing or shrinkage porosity to occur. As will be described in more detail below, the method illustrated in FIG. 2 may increase the size and/or permeability of the mushy zone, and thus decrease the head pressure required to force liquid alloy between solid grains and decrease the tendency for hot tearing or shrinkage porosity to result during the casting process.

In the method shown in FIG. 2, forced convection may be applied to the molten aluminum alloy 206 fed into the casting cavity to form an intermediate product 220, which may be different from the intermediate product 120 shown in FIG. 1. Specifically, the intermediate product 220 includes a first zone 222 into which molten aluminum alloy 206 may be fed, a second zone 224 below the first zone 222, and a third zone 226 below the second zone 224. Forced convection may be introduced in the first zone 222 to stir the molten aluminum alloy 206 fed into the casting cavity, as indicated by the circulating arrows in FIG. 2. Forced convection may be introduced to move or to circulate the content in the first zone 222 in a generally vertical direction, a generally horizontal direction, or a combination of vertical and horizontal circulation, or may be moved in any direction, depending on the mechanism implemented to force the convection.

By introducing forced convection in the first zone 222, the temperature in the first zone 222 may be equalized and may be maintained at a temperature below the liquidus temperature of the aluminum alloy, but still above the coherency temperature of the aluminum alloy, which may indicate that the first zone 222 is an upper portion of a mushy zone that is expanded in size as compared to casting without forced convection. The gradient of or variation in the temperature in the first zone 222 may be smaller be significantly less as compared to the temperature variation in the liquid zone 122 of FIG. 1, where no forced convection is introduced. In some embodiments, uniform or homogenous temperature in the first zone 222 may be achieved by using forced convection.

Figure 3A:
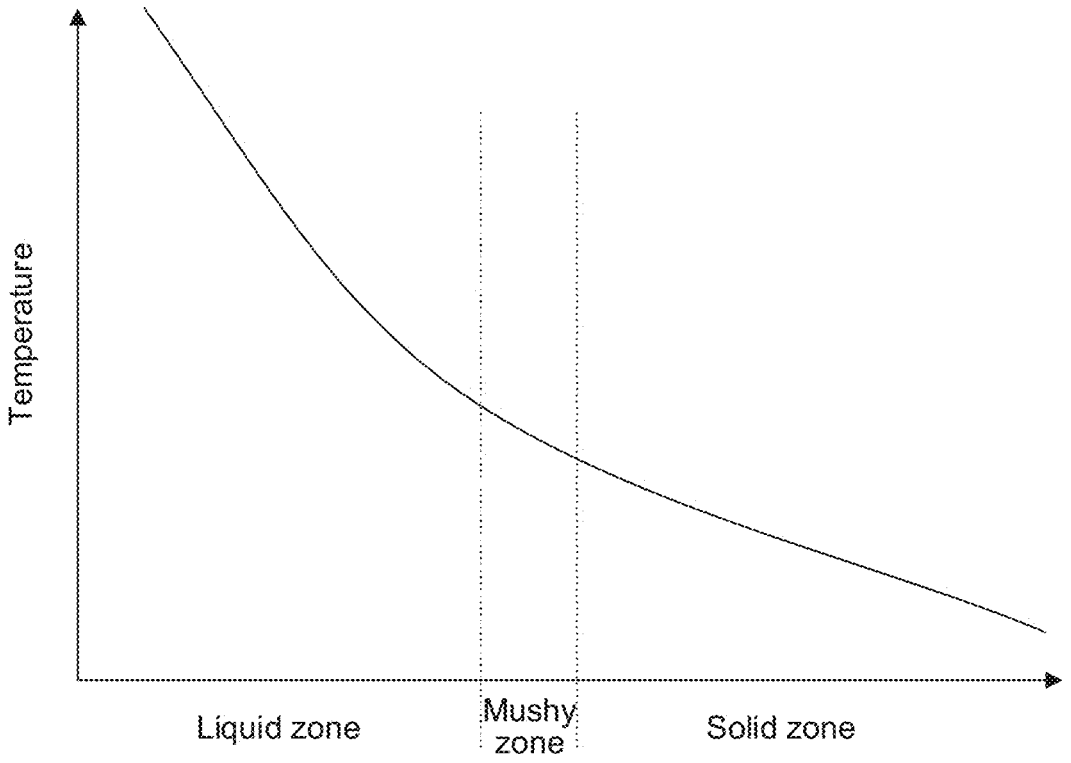
FIG. 3A Prior Art
FIG. 3A schematically illustrates the temperature across various zones of an intermediate product.
Figure 3B:
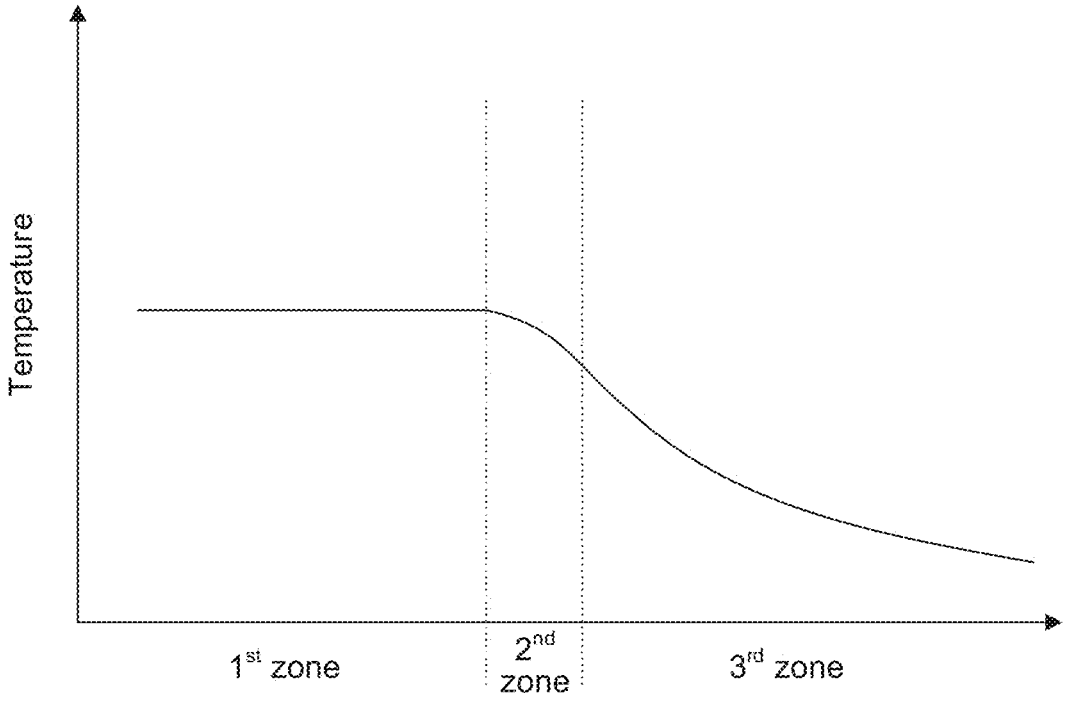
FIG. 3B schematically illustrates the temperature across various zones of another intermediate product.

FIG. 3A schematically illustrates an example temperature profile across the various zones of the intermediate product 120 as shown in FIG. 1. FIG. 3B schematically illustrates an example temperature profile across the various zones of the intermediate product 220 as shown in FIG. 2. As discussed above and also shown in FIG. 3A, the top region of the liquid zone 122 may have a temperature similar to the molten aluminum alloy 106, and the bottom region of the liquid zone 122 may have a temperature close to the coherency temperature of the aluminum alloy. Therefore, the temperature within the liquid zone 122 may not be uniform, but rather stratified. The coherence temperature, as well as the temperature stratification, may depend on the aluminum alloy, the casting cavity configuration, operating parameters of the casting/solidification process, such as cooling rate, etc. Depending on the aluminum alloy and the casting condition, the difference between the temperature in the top region and the temperature in the bottom region can range from 10° C. to 100° C. In some embodiments, the difference between the temperature in the top region and the temperature in the bottom region may be at least 10° C., may be greater than or about 15° C., greater than or about 20° C., greater than or about 30° C., greater than or about 40° C., greater than or about 50° C., greater than or about 60° C., greater than or about 70° C., greater than or about 80° C., greater than or about 90° C., greater than or about 100° C., greater than or about 110° C., greater than or about 120° C., greater than or about 130° C., greater than or about 140° C., greater than or about 150° C., greater than or about 160° C., greater than or about 170° C., greater than or about 180° C., greater than or about 190° C., or up to 200° C. Even when the temperature difference in the liquid zone 122 may be relatively small, the temperature stratification may still exist in the liquid zone 122 when the casting method as illustrated in FIG. 1 is employed. Further, in the method shown in FIG. 1, the molten alloy may be overheated to a temperature above the liquidus temperature and thus at least the top region in the liquid zone 122 may be overheated.

In contrast, by applying forced convection in the method shown in FIG. 2, the temperature stratification in the first zone 222 may be reduced or substantially eliminated (i.e., achieving a substantially uniform temperature within the first zone 222), independent of the aluminum alloy being cast and/or other operating parameters that may be employed. Further, by applying forced convection, the temperature with the first zone 222 may be maintained at a temperature below the liquidus temperature. In other words, by applying forced convection, overheating may not occur in the first zone 222. Depending on the aluminum alloy and/or casting condition, the temperature within the first zone 222 may be maintained at a temperature that may be 10° C. less than the liquidus temperature, 5° C. less than the liquidus temperature, 3° C. less than the liquidus temperature, or 1° C. less than the liquidus temperature.

In the liquid zone 122 shown in FIG. 1 and/or the first zone 222 shown in FIG. 2, natural convection may occur, but the effect of natural convection on the temperature stratification may be negligible. Further, although reduced stratification or substantially no stratification may be achieved using the method shown in FIG. 1 without forced convection, the casting rate would have to be extremely slow, which in turn would lead to distortion, cracking or other defects in the cast product.

In some embodiments where temperature stratification occurs, the temperature stratification of the first zone 222 may be evaluated by comparing the temperature variation from the top to the bottom of the first zone to the liquidus temperature of the aluminum alloy. The casting rate and the cooling rate may impact the temperature within the first zone 222, as introduction of more molten aluminum alloy 206 will bring additional heat with it, while the heat will be removed through the use of cooling water applied to the third zone 226. It may be desirable to control one or more of the cooling rate, the casting rate, and the amount of forced convection to control a temperature and size of at least the first zone 222 during casting. Depending on the aluminum alloy, the casting cavity configuration, operating parameters of the casting/solidification process, such as cooling rate, etc., the temperature variation across the first zone 222 may be less than 20% of the liquidus temperature in some embodiments, and may be less than 15%, less than 10%, less than 5%, less than 3%, or less than 1% of the liquidus temperature. Example temperature variations may be from 0% to 20% of the liquidus temperature, such as from 0% to 20%, from 0% to 15%, from 0% to 10%, from 0% to 5%, from 0% to 3%, from 0% to 1%, from 1% to 20%, from 1% to 15%, from 1% to 10%, from 1% to 5%, from 1% to 3%, from 3% to 20%, from 3% to 15%, from 3% to 10%, from 3% to 5%, 5% to 20%, from 5% to 15%, from 5% to 10%, from 10% to 20%, from 10% to 15%, or from 15% to 20%.

Depending on the alloy and the convection applied, the temperature within the first zone 222 may be maintained at 660±10° C., 650±10° C., 640±10° C., 630±10° C., 620±10° C., 610±10° C., 600±10° C., 590±10° C., 580±10° C., 570±10° C., 560±10° C., 550±10° C., 540±10° C., or lower, according to various embodiments. In some embodiments, the temperature may be maintained within a variation from the liquidus temperature of the aluminum alloy. The variation may be less than 2% of the liquidus temperature in some embodiments, and may be less than 1.5%, less than 1.0%, less than 0.5%, less than 0.3%, or less than 0.1% of the liquidus temperature.

Because the temperature within the first zone 222 is maintained below the liquidus temperature of the aluminum alloy, the first zone 222 may no longer be a liquid zone that is 100% molten or liquid aluminum alloy and may be considered a mushy zone or part of a mushy zone. Seed grains may form in the first zone 222, as shown in the upper insert of FIG. 2. The formed grains may not touch each other and may flow, float, or otherwise be suspended in the liquid aluminum alloy in the first zone 222. Thus, the first zone 222 may include a mixture of liquid aluminum alloy and seed grains, and thus may be similar to the upper region 132 of the mushy zone 124 in FIG. 1, where individual grains are formed and move relatively easily inside the liquid aluminum alloy. In some cases, the density of the grains inside the first zone 222 may be less given the significantly greater volume of the first zone 222 as compared to the upper region 132 of the mushy zone 124 in FIG. 1.

As the grains gradually grow, the grains may precipitate and form the second zone 224. The second zone 224 may be similar to the lower region 134 of the mushy zone 124 of FIG. 1, where the grains may begin to contact and form a continuous network as shown in the middle insert of FIG. 2. The temperature of the second zone 224 may range from the coherency temperature to the solidus temperature, for example.

Without forced convection, the grains may grow stochastically in random sizes and orientations. By introducing forced convection, however, the size, shape, and/or precipitation of the grains formed in the first zone 222 may be controlled such that the size and/or shape of the grains in the second zone 224 may be modified as compared to the mushy zone 124 of FIG. 1. The modified grains and, in particular, the modified shape of the grains, as will be discussed in more detail below, may increase permeability and thus reduce the required head pressure to feed liquid aluminum alloy into the interstitial spaces of the network of grains in the second zone 224. The reduction in the head pressure required may further reduce the tendency for hot tearing or shrinkage porosity to occur, as it may be easier to apply the required pressure. Consequently, the solid aluminum alloy in the third zone 226 may exhibit substantially no shrinkage porosity character and limit an amount or occurrence of hot cracking. In some embodiments, hot cracking or shrinkage porosity may still occur, but the amount of resultant defects may be significantly less as compared to a cast aluminum alloy product without forced convection. Specifically, without forced convection, when hot cracking occurs, the extent of the hot cracking or the defects associated therewith may be such that no feasible processing measures may be sufficient to remove those defects and the cast ingot may have to be entirely discarded. For example, without forced convection, hot cracking may lead to cracks that propagate to the surface of the ingot, which can cause oxidization within the crack and render the ingot non-usable for some applications. In contrast, when forced convection is introduced, the propensity of forming hot cracking may be reduced to the extent such that even if hot cracking may still occur, the defects associated therewith may be smaller in size and/or fewer in amount and may not propagate to the surface of the ingot. Further, the defects associated with hot cracking, if present, may be eliminated or reduced during subsequent processing operations that are commonly employed for processing the ingot without having to discard the cast ingot. In other words, by using forced convection, the cast product may include no defects due to hot cracking or only include a limited amount of defects due to hot cracking such that the cast product may still perform its intended function or such defects can be easily removed in subsequent processing.

Depending on the forced convection introduced, an average size of the seed grains formed in the first zone 222 may be from 10 μm to 50 μm. An average size of the grains in the third zone 226 may range from 20 μm to 150 μm in various embodiments, and may range from 30 μm to 150 μm, from 40 μm to 150 μm, from 50 μm to 150 μm, from 60 μm to 150 μm, from 70 μm to 150 μm, from 80 μm to 150 μm, from 90 μm to 150 μm, from 100 μm to 150 μm, from 110 μm to 150 μm, from 120 μm to 150 μm, from 130 μm to 150 μm, from 140 μm to 150 μm, from 20 μm to 140 μm, from 30 μm to 140 μm, from 40 μm to 140 μm, from 50 μm to 140 μm, from 60 μm to 140 μm, from 70 μm to 140 μm, from 80 μm to 140 μm, from 90 μm to 140 μm, from 100 μm to 140 μm, from 110 μm to 140 μm, from 120 μm to 140 μm, from 130 μm to 140 μm, from 20 μm to 130 μm, from 30 μm to 130 μm, from 40 μm to 130 μm, from 50 μm to 130 μm, from 60 μm to 130 μm, from 70 μm to 130 μm, from 80 μm to 130 μm, from 90 μm to 130 μm, from 100 μm to 130 μm, from 110 μm to 130 μm, from 120 μm to 130 μm, from 30 μm to 120 μm, from 40 μm to 120 μm, from 50 μm to 120 μm, from 60 μm to 120 μm, from 70 μm to 120 μm, from 80 μm to 120 μm, from 90 μm to 120 μm, from 100 μm to 120 μm, from 110 μm to 120 μm, from 20 μm to 110 μm, from 30 μm to 110 μm, from 40 μm to 110 μm, from 50 μm to 110 μm, from 60 μm to 110 μm, from 70 μm to 110 μm, from 80 μm to 110 μm, from 90 μm to 110 μm, from 100 μm to 110 μm, from 20 μm to 100 μm, from 30 μm to 100 μm, from 40 μm to 100 μm, from 50 μm to 100 μm, from 60 μm to 100 μm, from 70 μm to 100 μm, from 80 μm to 100 μm, from 90 μm to 100 μm, from 20 μm to 90 μm, from 30 μm to 90 μm, from 40 μm to 90 μm, from 50 μm to 90 μm, from 60 μm to 90 μm, from 70 μm to 90 μm, from 80 μm to 90 μm, from 20 μm to 80 μm, from 30 μm to 80 μm, from 40 μm to 80 μm, from 50 μm to 80 μm, from 60 μm to 80 μm, from 70 μm to 80 μm, from 20 μm to 70 μm, from 30 μm to from 40 μm to 70 μm, from 50 μm to 70 μm, from 60 μm to 70 μm, from 20 μm to from 30 μm to 60 μm, from 40 μm to 60 μm, from 50 μm to 60 μm, from 20 μm to from 30 μm to 50 μm, from 40 μm to 50 μm, from 20 μm to 40 μm, from 30 μm to or from 20 μm to 30 μm. The average grain size in the third zone 226 of solid aluminum alloy may be generally greater than the average grain size in the second zone 224, which may be generally greater than the average seed grain size in the first zone 222. However, the average grain size in the third zone 226 may be smaller as compared to the average grain size in the solid zone 126 of FIG. 1 where no forced convention is applied (e.g., for the same alloy, casting rate, cooling rate, etc.). In some embodiments, the average grain size in the third zone 226 may be reduced by 5%, 10%, 15%, 20%, 25%, 30%, 35%, 40%, 45%, 50%, 55%, 60%, or more, as compared to the average grain size of the solid zone 126 since the average grain size of a cast aluminum alloy product in which forced convection is not implemented may range from 120 μm to 250 μm, for example. An overall reduction in grain size may reduce the cast aluminum alloy product's tendency to crack during cooling and/or subsequent processing. However, a further reduced grain size may decrease permeability of the second zone 224 under certain conditions. Therefore, the forced convection may be controlled such that the average grain size may not be less than 20 μm.

The reduced permeability due to reduced grain size may be explained using the Kozeny-Carman equation, which describes the pressure drop associated with fluid flow through a packed bed of solids or the required increase in the pressure to infiltrate a packed bed. The generalized form of the Kozeny-Carman equation is represented as:

$$\frac{\Delta p}{L} = \frac{-180\mu}{\varphi_s^2 D_p^2} \frac{(1-\epsilon)^2}{\epsilon^3} v_s$$

where Δp represents pressure drop, L represents length (height) of bed, μ represents viscosity of the feeding fluid, $\varphi_s$ represents sphericity of the media, $D_p$ represents grain (particle) diameter, E represents porosity (void fraction) of the bed, and $v_s$ represents superficial velocity. Based on the Kozeny-Carman equation, a decrease in grain size, which would correlate to a decrease in particle diameter, would result in an increase in the required pressure to infiltrate the second zone 224. Stated differently, the decrease in grain size would correlate to a decrease in permeability, and consequently, an increase in hot-tearing sensitivity.

Unexpectedly, despite the reduction in the grain size, the tendency for hot tearing or shrinkage porosity to occur actually has been reduced when forced convection is used during solidification. Upon further investigation, the change in grain morphology may be an important factor in reducing the hot tearing tendency.

In addition to reduced grain size, the shape of the grains may also be modified by forced convection. Without forced convection, the grain structure may be dendritic or tree-like. By introducing forced convection, however, the grain structure may be modified from the dendritic structure to a more spherical or circular structure, as shown in the lower insets of FIG. 2. Without intending to be bound to any particular theory, a more spherical or circular grain structure may be formed because forced convection may move the liquid surrounding the seed grains and thus promote a more uniform and/or spherical growth around the seed grains.

Figure 4:
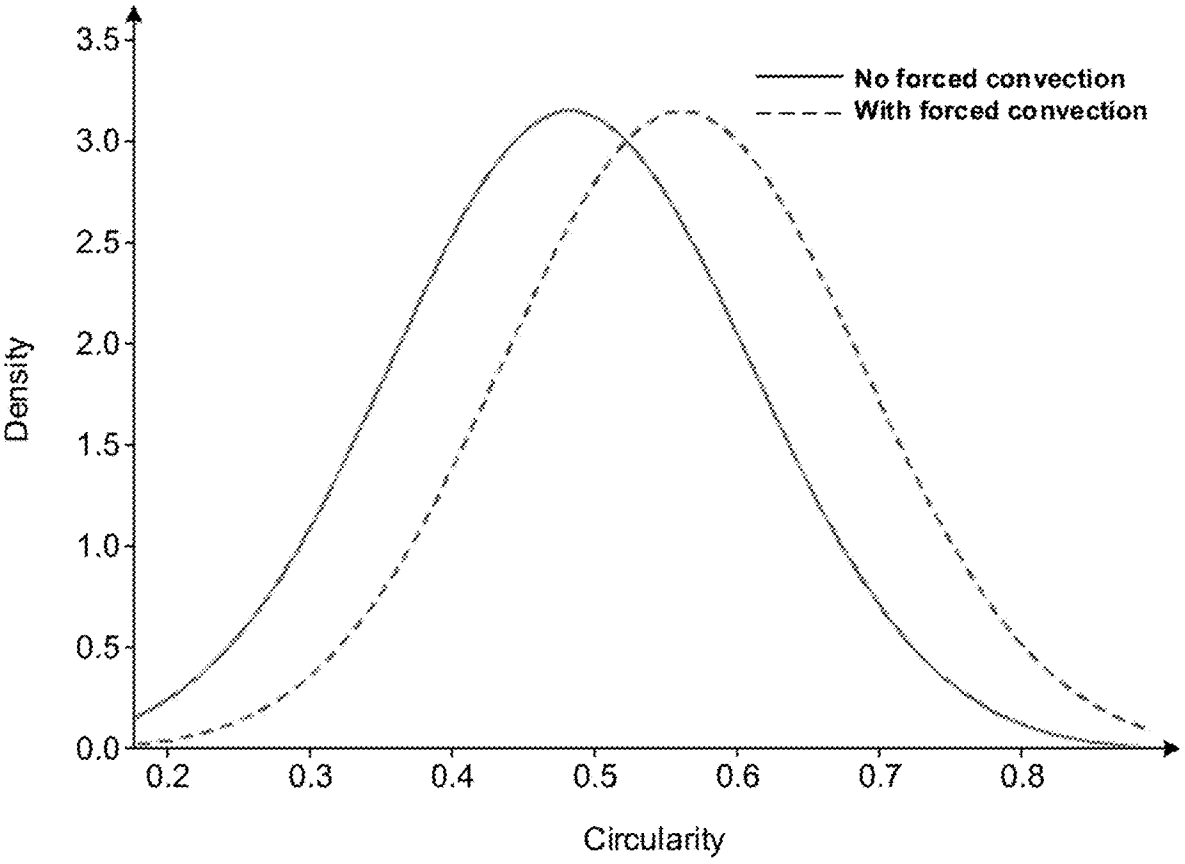
FIG. 4 illustrates circularity distributions of grains formed in different aluminum alloy products.

FIG. 4 illustrates circularity measurements of grains formed in sample cast aluminum alloy products cast with and without forced convection. In this embodiment, the grain circularity is calculated as follows using the equation below:

$$\text{Circularity} = 4\pi\frac{\text{Area}}{\text{Perimeter}^2}$$

where Area represents the grain area in the sample, and Perimeter represents the perimeter of the grain. The circularity value ranges from 0 to 1, with a circle having a circularity value of 1.

Although circularity is calculated for comparison between samples with and without forced convection, similar trends may be observed when other similar morphology characteristics, such as sphericity, may be determined for evaluating the effects of forced convection. As shown in FIG. 4, when forced convection is utilized, there is an increase in the circularity of the grains in the sample as compared to the sample produced without using forced convection. Stated differently, when forced convection is utilized, the grain circularity or spherecity may be improved. Improved grain circularity and/or sphericity may advantageously improve the permeability of the network of grains for the liquid aluminum alloy to fill the interstitial spaces between grains as the system cools, and thus reduce the tendency for the hot tearing or shrinkage porosity to occur. Without intending to be bound to any particular theory, the permeability may be improved because a more circular or spherical grain structure may provide a more straightforward and less tortuous path for the liquid aluminum alloy to travel through and around the grains to fill the interstitial spaces in the connected network of the aluminum alloy grains.

Depending on the alloy and the mechanism employed for forcing convection, the average circularity of the grains in the formed aluminum alloy product may range from 0.5 to 1 in some embodiments, and may range from 0.55 to 1, 0.6 to 1, from 0.65 to 1, from 0.7 to 1, from 0.75 to 1, from 0.8 to 1, from 0.85 to 1, from 0.9 to 1, or from 0.95 to 1 in various embodiments. Other example circularity ranges include from 0.55 to 0.6, from 0.55 to 0.65, from 0.55 to 0.7, from 0.55 to 0.75, from 0.55 to 0.8, from 0.55 to 0.9, from 0.55 to 0.95, from 0.6 to 0.65, from 0.6 to 0.7, from 0.6 to 0.75, from 0.6 to 0.8, from 0.6 to 0.9, from 0.6 to 0.95, from 0.65 to 0.7, from 0.65 to 0.75, from 0.65 to 0.8, from 0.65 to 0.9, from 0.65 to 0.95, from 0.7 to 0.75, from 0.7 to 0.8, from 0.7 to 0.9, from 0.7 to 0.95, from 0.75 to 0.8, from 0.75 to 0.85, from 0.75 to 0.9, from 0.8 to 0.85, from 0.8 to 0.9, from 0.8 to 0.95, from 0.85 to 0.9, from 0.85 to 0.95, or from 0.9 to 0.95.

Compared with aluminum alloy products cast under similar conditions but without forced convection, the grain circularity of the aluminum alloy products formed using forced convection may be increased by at least 0.05, at least 0.1, at least 0.15, at least 0.2, at least 0.25, at least 0.3, at least 0.35, at least 0.4, at least 0.45, at least 0.5, at least 0.6, at least 0.7, at least 0.8, or more. Generally, when no forced convection is applied, aluminum alloy products that are cast from aluminum alloys having a relatively high content/amount of alloying element(s) may generally have a grain circularity lower than the aluminum alloy products formed of aluminum alloys having a relatively low content/amount of alloying element(s). For example, the grain circularity of an aluminum alloy product cast from a 4xxx series aluminum alloy, which may include relatively high amounts of alloying elements (e.g., 7-12% silicon), may be about 0.2 without forced convection; the grain circularity of an aluminum alloy product cast from a 5xxx series aluminum alloy, which may include medium amounts of alloying elements (e.g., 3-5% magnesium), may be about 0.3-0.4 without forced convection; the grain circularity of an aluminum alloy product cast from a 6xxx series aluminum alloy, which may include relatively low amounts (e.g., <2%) of various alloying elements may be about 0.5 without forced convection. By applying forced convection as described herein during casting, an increase in the grain circularity can be obtained whether the aluminum alloys includes relatively high or low content/amount of alloying elements, and a resulting grain circularity from 0.5 to 1, from 0.55 to 1, 0.6 to 1, from 0.65 to 1, from 0.7 to 1, from 0.75 to 1, from 0.8 to 1, from 0.85 to 1, from 0.9 to 1, or from 0.95 to 1 can be achieved. In some embodiments, a ratio of the grain circularity of an aluminum alloy product obtained with forced convection during the casting process to the grain circularity of another aluminum alloy product obtained without forced convection but using the same aluminum alloy may range from 5:1 to 1.1:1, and may range from 4.5:1 to 1.1:1, from 4:1 to 1.1:1, from 3.5:1 to 1.1:1, from 3:1 to 1.1:1, from 2.5:1 to 1.1:1, from 2:1 to 1.1:1, from 1.5:1 to 1.1:1, from 5:1 to 1.5:1, from 4.5:1 to 1.5:1, from 4:1 to 1.5:1, from 3.5:1 to 1.5:1, from 3:1 to 1.5:1, from 2.5:1 to 1.5:1, from 2:1 to 1.5:1, from 5:1 to 2:1, from 4.5:1 to 2:1, from 4:1 to 2:1, from 3.5:1 to 2:1, from 3:1 to 2:1, from 2.5:1 to 2:1, from 5:1 to 2.5:1, from 4.5:1 to 2.5:1, from 4:1 to 2.5:1, from 3.5:1 to 2.5:1, from 3:1 to 2.5:1, from 5:1 to 3:1, from 4.5:1 to 3:1, from 4:1 to 3:1, from 3.5:1 to 3:1, from 5:1 to 3.5:1, from 4.5:1 to 3.5:1, from 4:1 to 3.5:1, from 5:1 to 4:1, from 4.5:1 to 4:1, or from 5:1 to 4.5:1.

In some embodiments, the temperature in the first zone 222 may still vary from the top region to the bottom region. However, the variation in the temperature may be controlled by forced convection to be less than 10° C., less than 5° C., less than 3° C., less than 1° C., or as small as 0° C. Accordingly, by using forced convection, the temperature variation across the first zone 222 may be less than 50% of the temperature variation when no forced convection is applied in some embodiments, or may be less than 40%, less than 30%, less than 20%, less than 10%, less than 5%, less than 3%, or less than 1% of the temperature variation when no forced convection is applied in various embodiments.

Several mechanism for forcing convection may be implemented. In some embodiments, convection may be forced by stirring the content in, e.g., the first zone 222 shown in FIG. 1. Any suitable stirring mechanism may be employed. In some embodiments, an ultrasonic stirrer may be utilized. In some embodiments, the casting system may be configured with a built-in ultrasound generator, such as an ultrasound generating transducer, to agitate the liquid aluminum alloy and the seed grains in the first zone 222. In some embodiments, an external ultrasound generator, such as an ultrasonic probe, may be lowered into the first zone 222 to agitate the liquid aluminum alloy and the seed grains. By selecting the appropriate frequency of the ultrasonic stirrer, a desired temperature point or temperature range, such as those described above, may be achieved. In some embodiments, the selected frequency of the ultrasonic stirrer may range from 20 kHz to 30 kHz.

In some embodiments, a mechanical stirrer, such as a paddle or propeller, either built-in or external, may be utilized. The paddle or propeller may be constructed using a material that can withstand high temperature and thus limit the amount of impurities that may be introduced into the cast product. For example, the paddle or propeller may be subjected to relatively high temperatures for hours, depending on the aluminum alloy and/or the casting condition. However, as discussed above, the temperature the paddle or propeller may be subjected to during stirring may be below the liquidus temperature of the aluminum alloy. As such, the thermal requirements for the paddle or propeller may be less stringent than those for furnace refractory, which may experience higher temperatures (e.g., due to superheating above the liquidus temperature) for extended durations. Exemplary material for making the paddle or propeller or for coating a paddle or propeller made of a different material may include aluminum oxide, aluminum nitride, graphite, and other various refractory materials, depending on the aluminum alloy. In some embodiments, the paddle or propeller may be coated with a non-wetting compound, such as boron nitride, which may enhance the lifetime of the paddle or propeller.

In some embodiments, instead of using a stirrer, the casting system may be configured with a pumping system configured to pump the liquid aluminum alloy and the seed grains contained therein from the lower region of the first zone 222 into the upper region of the first zone 222. The pumped liquid aluminum alloy and the seed grains contained therein may be pumped directly back to the first zone 222 or may be mixed with additional molten aluminum alloy before being pumped into the first zone 222. In some embodiments, the pumping system may include one or more loops used for transporting the liquid aluminum alloy and the seed grains contained therein. Suitable molten metal pumps are described in U.S. application Ser. No. 14/719,050, filed on May 21, 2015, which is hereby incorporated by reference in its entirety. In some embodiments, a liquid metal jet may be employed for applying forced convection within the first zone 222, such as described in U.S. application Ser. No. 15/468,285, filed on Mar. 24, 2017, which is hereby incorporated by reference in its entirety.

In embodiments, forced convection may be controlled so as to achieve a desired temperature or temperature variation of the first zone 222 and characteristics (such as a target material property) of the third zone 226. The target material property may include porosity, average grain size, grain circularity, or the like. For example, forced convection may be controlled by adjusting a mixing rate in the first zone 222, such as by modifying a speed of a paddle, propeller, pumping rate, an ultrasonic stirring frequency or intensity, jet direction, or other like techniques used for forcing convection within the first zone 222. In some cases, a flow rate and/or temperature of molten aluminum alloy 206 into the casting cavity may also or alternatively be used to control or modify a rate of forced convection. Optionally, a casting method may explicitly include controlling a rate of forced convection.

The various mechanisms for forcing convection are described herein only for purposes of illustration and description and are not intended to be exhaustive or limiting. Any other suitable mechanisms or techniques may be utilized to force convection. Although the methods for improved grain circularity and reduced hot tearing tendensity are described with reference to the DC casting process depicted in FIG. 2, the methods described herein can be applied in any suitable casting method, some of which are described above.

Further, because improved grain circularity and/or reduced hot cracking can be achieved by forcing convection, the methods described herein may allow a wider window of the cooling speed to be implemented without increasing the propensity of hot cracking. For example, in the case of DC casting, a cooling speed from 1° C./second to 10° C./second may optionally be implemented. Depending on the dimension of the cast ingot, the cooling speed may range from 1° C./second to 10° C./second, 2° C./second to 10° C./second, 3° C./second to 10° C./second, 4° C./second to 10° C./second, 5° C./second to 10° C./second, 6° C./second to 10° C./second, 7° C./second to 10° C./second, 8° C./second to 10° C./second, 9° C./second to 10° C./second, 1° C./second to 9° C./second, 2° C./second to 9° C./second, 3° C./second to 9° C./second, 4° C./second to 9° C./second, 5° C./second to 9° C./second, 6° C./second to 9° C./second, 7° C./second to 9° C./second, 8° C./second to 9° C./second, 1° C./second to 8° C./second, 2° C./second to 8° C./second, 3° C./second to 8° C./second, 4° C./second to 8° C./second, 5° C./second to 8° C./second, 6° C./second to 8° C./second, 7° C./second to 8° C./second, 1° C./second to 7° C./second, 2° C./second to 7° C./second, 3° C./second to 7° C./second, 4° C./second to 7° C./second, 5° C./second to 7° C./second, 6° C./second to 7° C./second, 1° C./second to 6° C./second, 2° C./second to 6° C./second, 3° C./second to 6° C./second, 4° C./second to 6° C./second, 5° C./second to 6° C./second, 1° C./second to 5° C./second, 2° C./second to 5° C./second, 3° C./second to 5° C./second, 4° C./second to 5° C./second, 1° C./second to 4° C./second, 2° C./second to 4° C./second, 3° C./second to 4° C./second, 1° C./second to 3° C./second, 2° C./second to 3° C./second, or 1° C./second to 2° C./second.

For billet casting, a cooling speed from 10° C./second to 100° C./second may optionally be implemented. Depending on the size (e.g., diameter) of the billets to be formed, the cooling speed may range from 10° C./second to 100° C./second, 20° C./second to 100° C./second, 30° C./second to 100° C./second, 40° C./second to 100° C./second, 50° C./second to 100° C./second, 60° C./second to 100° C./second, 70° C./second to 100° C./second, 80° C./second to 100° C./second, 90° C./second to 100° C./second, 10° C./second to 90° C./second, 20° C./second to 90° C./second, 30° C./second to 90° C./second, 40° C./second to 90° C./second, 50° C./second to 90° C./second, 60° C./second to 90° C./second, 70° C./second to 90° C./second, 80° C./second to 90° C./second, 10° C./second to 80° C./second, 20° C./second to 80° C./second, 30° C./second to 80° C./second, 40° C./second to 80° C./second, 50° C./second to 80° C./second, 60° C./second to 80° C./second, 70° C./second to 80° C./second, 10° C./second to 70° C./second, 20° C./second to 70° C./second, 30° C./second to 70° C./second, 40° C./second to 70° C./second, 50° C./second to 70° C./second, 60° C./second to 70° C./second, 10° C./second to 60° C./second, 20° C./second to 60° C./second, 30° C./second to 60° C./second, 40° C./second to 60° C./second, 50° C./second to 60° C./second, 10° C./second to 50° C./second, 20° C./second to 50° C./second, 30° C./second to 50° C./second, 40° C./second to 50° C./second, 10° C./second to 40° C./second, 20° C./second to 40° C./second, 30° C./second to 40° C./second, 10° C./second to 30° C./second, 20° C./second to 30° C./second, or 10° C./second to 20° C./second.

For continuous casting, such as casting between two opposing surfaces, for example as described in U.S. Pat. No.

8,662,145, the content of which is incorporated herein in its entirety for all purposes, a cooling speed from 100° C./second to 800° C./second may optionally be implemented. Depending on thickness of slab formed, the cooling speed may range from 100° C./second to 800° C./second, 200° C./second to 800° C./second, 300° C./second to 800° C./second, 400° C./second to 800° C./second, 500° C./second to 800° C./second, 600° C./second to 800° C./second, 700° C./second to 800° C./second, 100° C./second to 700° C./second, 200° C./second to 700° C./second, 300° C./second to 700° C./second, 400° C./second to 700° C./second, 500° C./second to 700° C./second, 600° C./second to 700° C./second, 100° C./second to 600° C./second, 200° C./second to 600° C./second, 300° C./second to 600° C./second, 400° C./second to 600° C./second, 500° C./second to 600° C./second, 100° C./second to 500° C./second, 200° C./second to 500° C./second, 300° C./second to 500° C./second, 400° C./second to 500° C./second, 100° C./second to 400° C./second, 200° C./second to 400° C./second, 300° C./second to 400° C./second, 100° C./second to 300° C./second, 200° C./second to 300° C./second, or 100° C./second to 200° C./second.

By introducing forced convection, in embodiments, a grain circularity of 0.5 or greater, such as 0.55 to 1, can be obtained while any cooling speed within the ranges listed above for different casting methods may be implemented without increasing the propensity of hot cracking.

Methods of Using the Disclosed Aluminum Alloy Products

The aluminum alloy products described herein can be used in automotive applications and other transportation applications, including aircraft and railway applications. For example, the disclosed aluminum alloy products can be used to prepare automotive structural parts, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The aluminum alloy products and methods described herein can also be used in aircraft or railway vehicle applications, to prepare, for example, external and internal panels.

The aluminum alloy products and methods described herein can also be used in electronics applications. For example, the aluminum alloy products and methods described herein can be used to prepare housings for electronic devices, including mobile phones and tablet computers. In some examples, the aluminum alloy products can be used to prepare housings for the outer casing of mobile phones (e.g., smart phones), tablet bottom chassis, and other portable electronics.

Aspects of the invention may be further understood by reference to the following non-limiting examples.

Example 1

The Kozeny-Carman relationship is a widely acknowledged analytical model that describes the permeability of porous structures using structural parameters. This model can be applied to DC casting simulations and descriptions to describe the hot-tearing sensitivity of the mushy zone. Often, the structural parameters used in the Kozeny-Carman expression are difficult to obtain and uniform values are applied for a variety of casting conditions. However, changes in fluid flow within the molten pool with all other casting conditions identical can significantly alter the microstructure, and thus the permeability of the mushy zone. This example describes a set of stirring experiments performed using a standard DC casting setup, which demonstrate the relative importance of not only the grain size, but also the grain morphology in decreasing the hot-cracking sensitivity of cast aluminum products.

During solidification, metallic alloys undergo deformation caused by both thermal contraction and solidification shrinkage. If this deformation is not compensated by commensurate liquid phase flow, the liquid pressure may drop to negative value in the event a gas phase is unable to nucleate. If the solid grains are not too tightly packed, this pressure can induce a rearrangement of the solid grains. Thus, the ability of the liquid phase to feed between grains, and the ability of the solid skeleton to contract within the mushy zone determine the maximum pressure drop within the liquid. If this liquid pressure falls below a given "cavitation pressure", a void may form and nucleate a hot tear. Hot tearing is an intergranular defect that forms as a result of thermal strains in the coherent solid and insufficient liquid feeding. Its intergranular nature is linked to the presence of thin liquid films that remain at grain boundaries of dilute alloys until late stages of the solidification process. These films cannot sustain mechanical tensile and shear strains induced and transmitted by the coherent solid, and thus behave as a brittle phase. Consequently, localized strains at those "wetted" grain boundaries can no longer be compensated by liquid feeding due to the very low permeability of the mushy zone.

Experiment.

Figure 5:
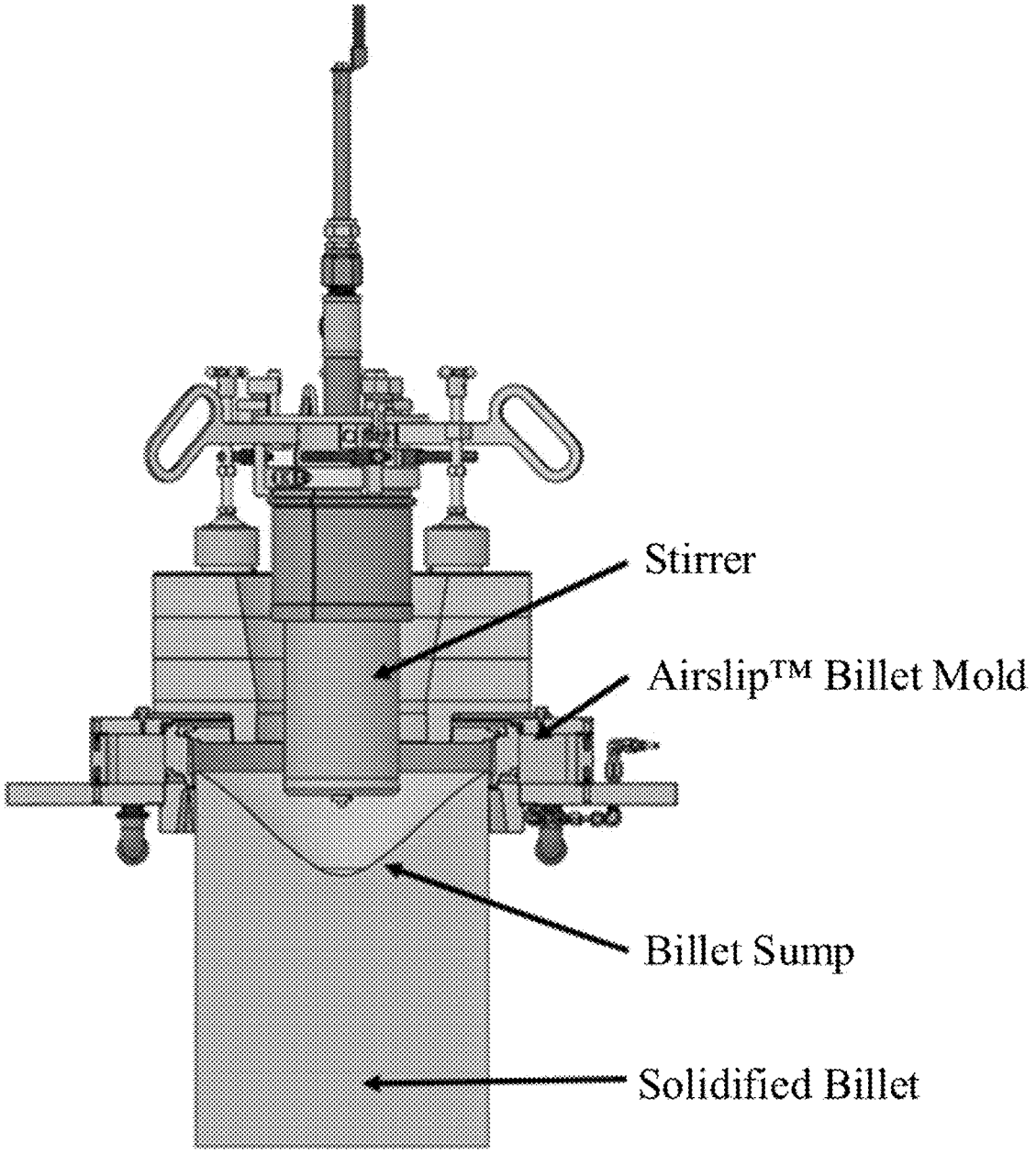
FIG. 5 illustrates an experimental setup configured to stir molten and semi-solid aluminum and/or aluminum alloy.

A 14 inch diameter Wagstaff AIRSLIP™ mold was used to cast AA6061 billets, using the chemistry in Table 1. A computer rendering of the experimental setup is represented FIG. 5. Billets were cast in a standard method (no stirring) and repeated at the same speed in a separate cast using stirring to introduce forced convection to compare microstructural properties and hot cracking performance between standard casting and forced convection. When forced convection was introduced for a cast, a stirrer was lowered into the mold at 0.3 m of cast length; the stirrer was submerged so that the bottom of the stirrer was 9 inches below the trough metal level. The stirrer was configured in a manner such that the metal flowed in a circular path around the wall of the billet. The positions of the stirrer have been configured for the experimental billet casting system in the present investigation.

TABLE 1

AA6061 Billet chemistry used for analysis

| Element | Si | Fe | Cu | Mn | Mg | Cr | Zn | Ti | Na | Ca |
|---|---|---|---|---|---|---|---|---|---|---|
| Weight % | 0.68 | 0.27 | 0.27 | 0.007 | 1.06 | 0.07 | 0.003 | 0.006 | 0.0005 | 0.0008 |

The casting speed was increased with every set of standard and stirred casts until the billet developed hot cracks, which were identified by using an ultrasonic probe placed below the mold. A small amount of grain refiner was added at the beginning of the cast to help ensure that the cast start was successful; no further grain refiner was added to the metal after this point.

The flow of metal from trough to the mold was temporarily paused mid-cast at 1.5 and 3 pre-melted pounds of Al-6.8Zn were added to the trough in place of the 6061 metal flow. A high concentration zinc material was added to the billet mid-cast to highlight the shape of the sump in the billet with macro-etching following casting which allowed analysis of the mushy zone.

Billets cast at a speed of 72 mm/min using a standard set up (no stirring) and the stirred billet were selected for analysis. The billets were sectioned along the diameter and macro-etched using a tri-acid etch to highlight the Zn sump line. Samples were taken from the billet cross-section at the intersection of four inches away from the cast surface and the highlighted Zn sump line and polished for microstructure analysis.

Figure 6:
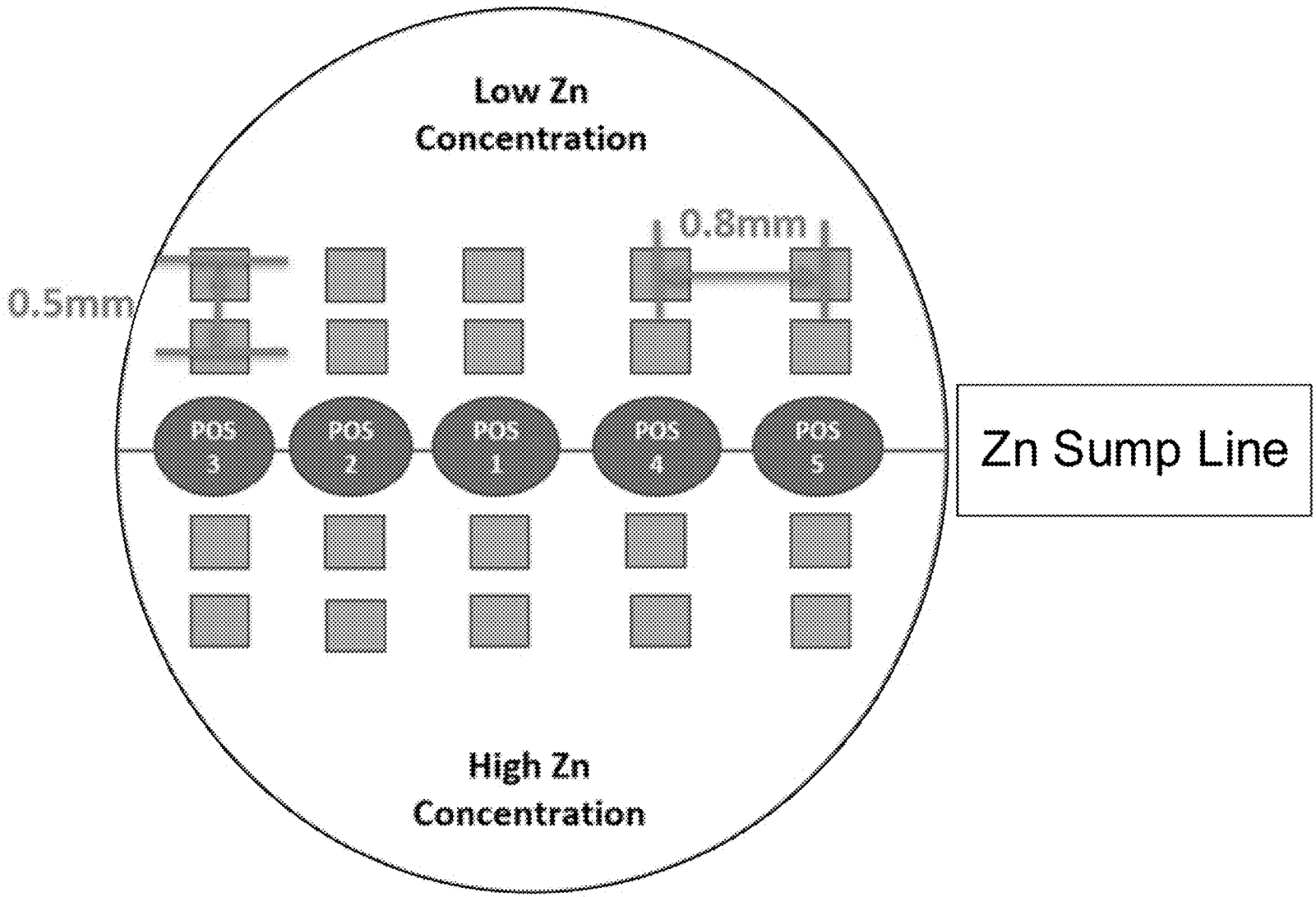
FIG. 6 illustrates a diagram of a sample with a layout of positions and spacing of SEM (scanning electron microscope) images.

To determine the penetration distance of the Zn in the mushy zone, EDS analysis using a Hitachi SU1510 SEM (scanning electron microscope) was performed along the axis perpendicular to the sump line to find the distance of the area of low Zn concentration to the area of high Zn concentration. Starting at a position along the sump line, a 0.8 mm by 0.5 mm EDS area scan was completed. In increments of 0.5 mm, area scans were taken until the high Zn concentration area (~5% Zn) and the low Zn area (~0% Zn) was measured, with the length between the two concentration areas defined as the penetration distance. This process was repeated in lines spaced 0.8 mm apart for a total of five scans to achieve a representative penetration distance. A diagram of a sample with the layout of positions and spacing of SEM images is shown in FIG. 6.

To understand the morphology and sphericity of each sample, Aztec EBSD (electron backscatter diffraction) software was used. ImageJ, an image processing software, was used to determine the grain perimeter and grain area from the EBSD images. The samples were etched using Barker's reagent and average grain size was measured from the etched grain images. Circularity was calculated using the grain area and perimeter as defined in equation (1). A circularity value of 1.0 represents a perfect circle, and as the circularity approaches 0.0, the shape is increasingly elongated.

$$\text{Circularity} = 4\pi \frac{\text{Area}}{\text{Perimeter}^2} \tag{1}$$

Results.

A summary of the experimental microstructure results is presented below in Table 2. The maximum speed without cracking for the stirred billet is 25% higher than that for the standard billet. The stirred billet also exhibited significant grain refinement, reducing the average grain size by 57% from the standard case. Simultaneously, the grains of the stirred billet were more circular than those of the standard billet. It is acknowledged that the proper measure for three dimensional grains should be sphericity, as 2-D micrographs were taken, the measure was adjusted to "circularity".

TABLE 2

Summary of casting speed and microstructural parameters for the two billets.

| | Standard Billet | Stirred Billet |
|---|---|---|
| Maximum Casting Speed | 75 mm/min | 100 mm/min |
| Average Grain Size | 223 μm | 95 μm |
| Average Grain Circularity | .49 | .57 |

Figure 7:
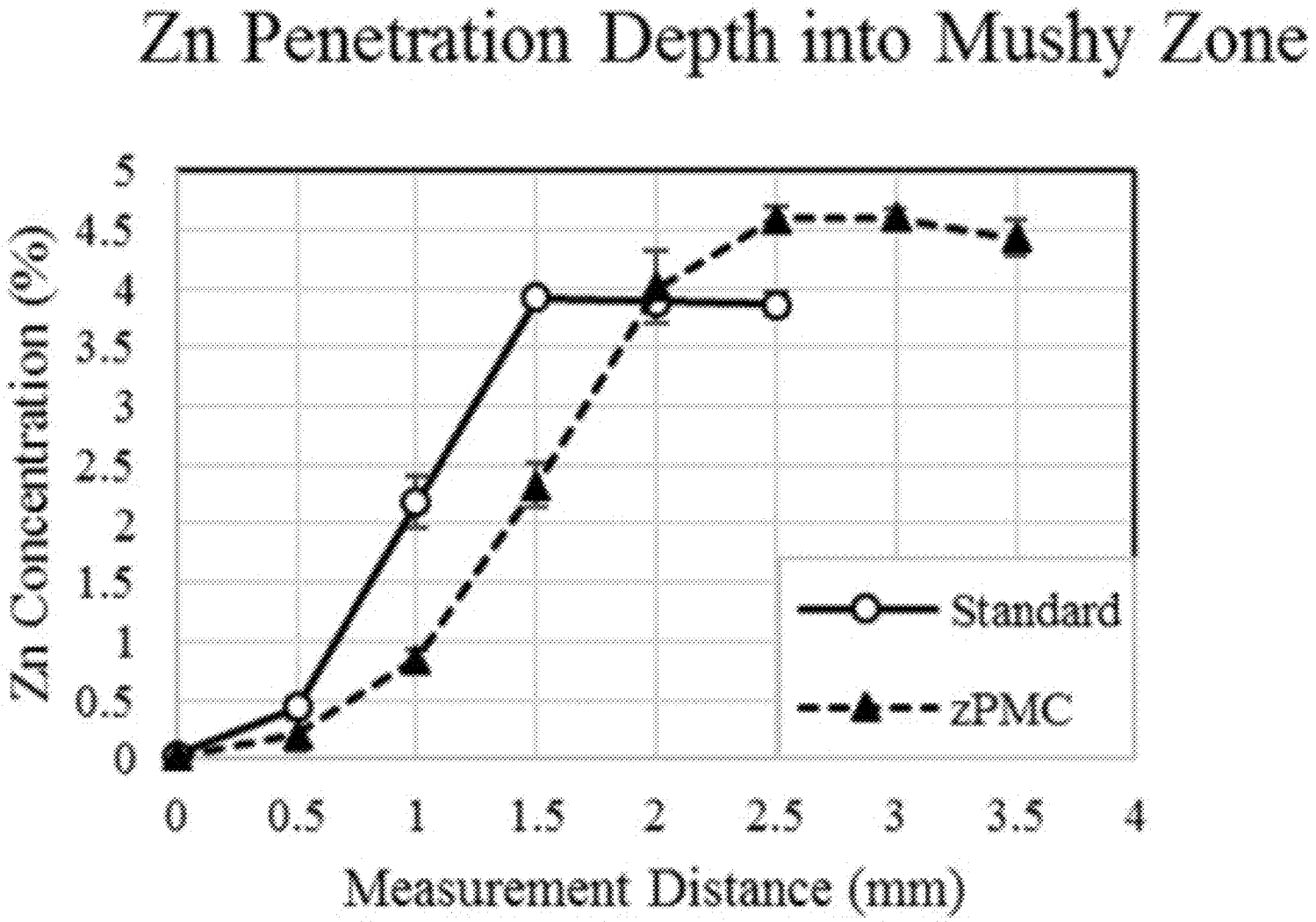
FIG. 7 illustrates average Zn penetration into a mushy zone for various samples.

The Zn values measured by the EDS area scans perpendicular to the sump line as described in the experimental section are shown in FIG. 7. Each Zn concentration value on the graph represents an average of five EDS measurements at the specified distance. As is shown here, the zinc penetration depth is roughly 60% higher for the stirred billet than for the standard billet.

Figure 8A:
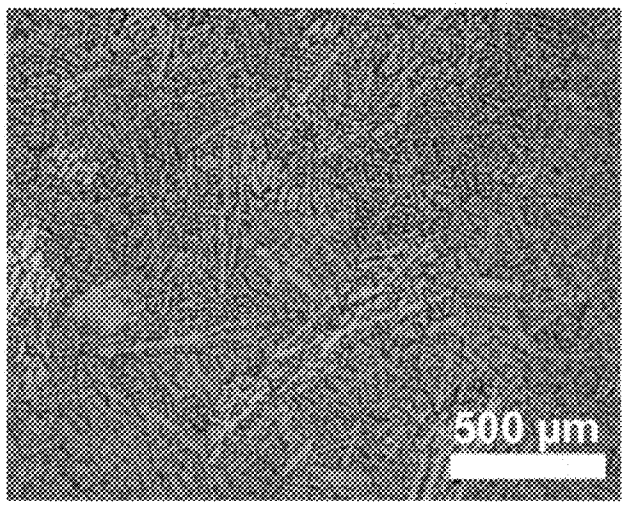
FIG. 8A, FIG. 8B, FIG. 8C, and FIG. 8D depict representative grain images taken using an optical microscope and EBSD (electron backscatter diffraction).
Figure 8B:
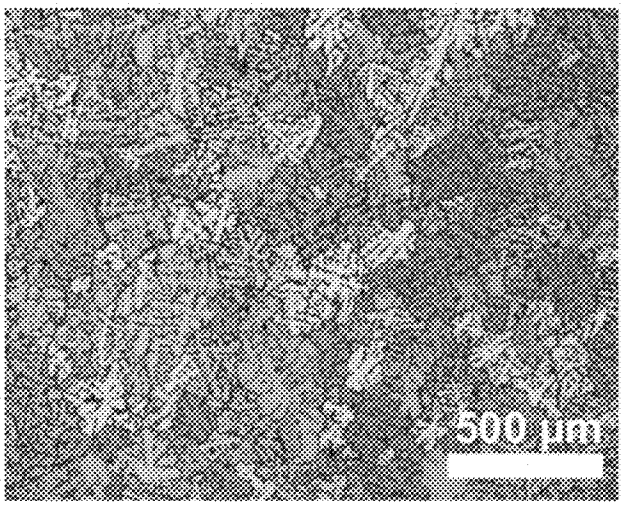
Figure 8C:
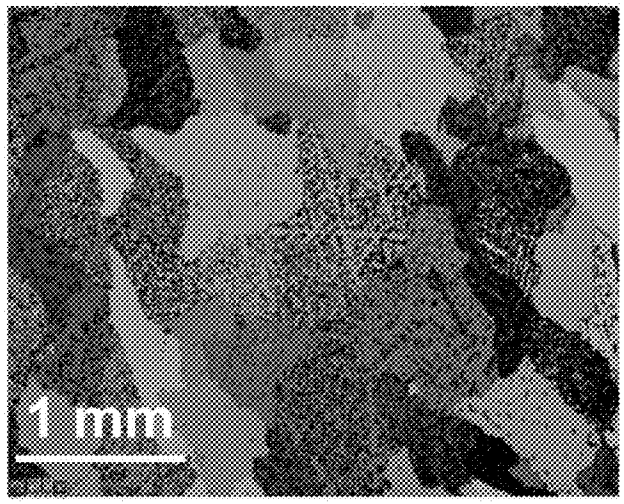
Figure 8D:
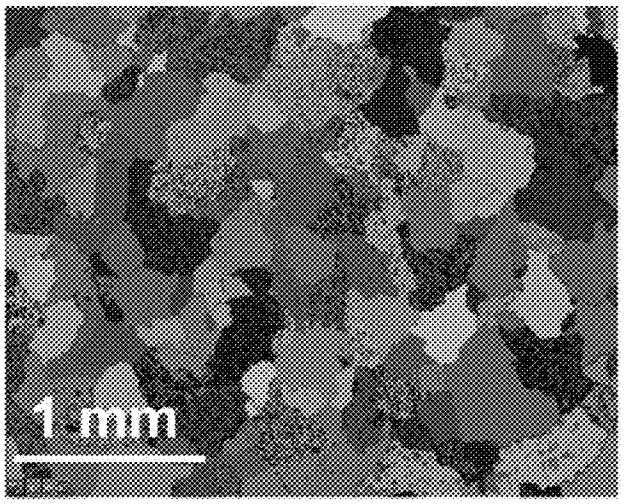
Figure 9A:
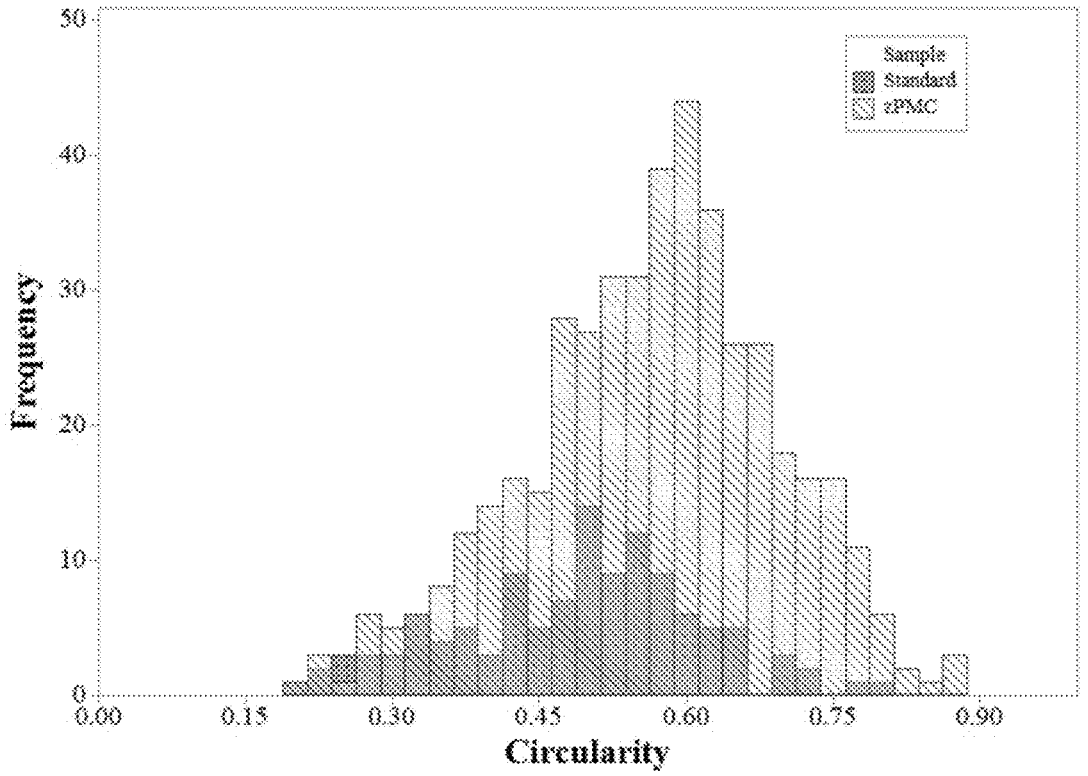
FIG. 9A illustrates a histogram of circularity of grains of various samples.
Figure 9B:
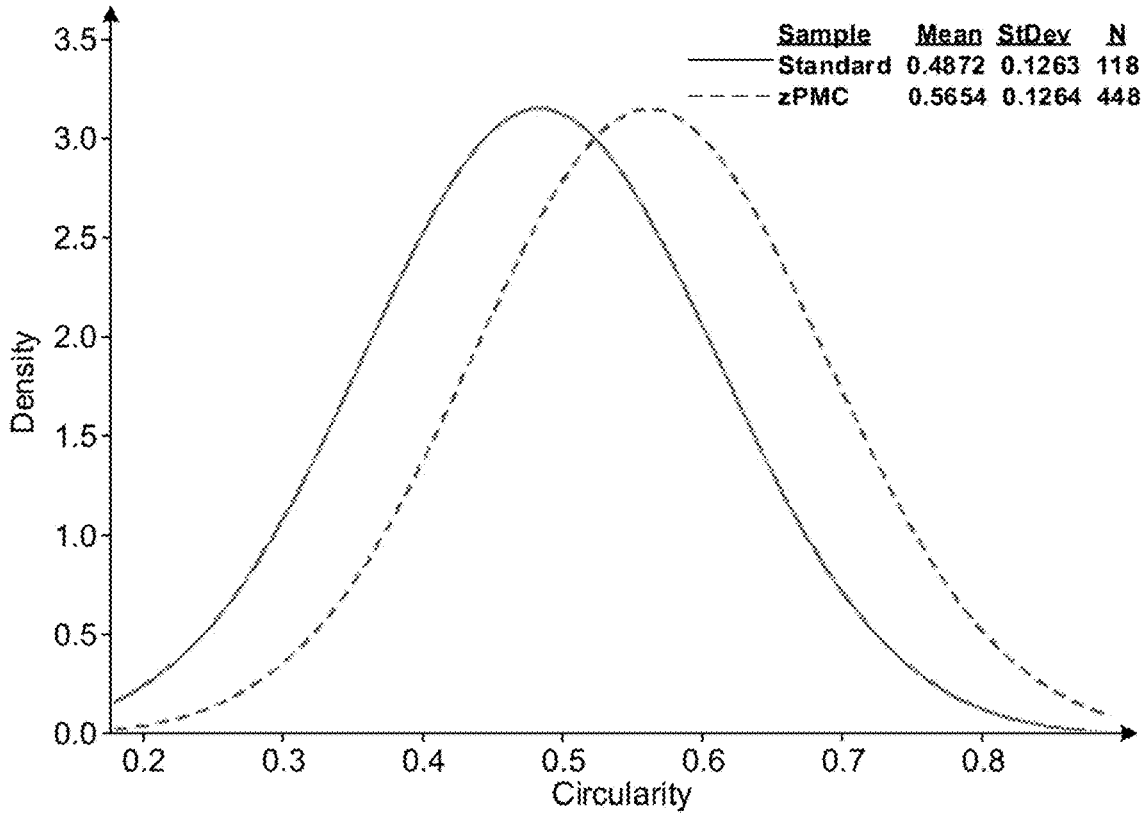
FIG. 9B illustrates a normalized histogram of the histogram shown in FIG. 9A.

Grain images were used to determine the average grain size. FIG. 8A, FIG. 8B, FIG. 8C, and FIG. 8D show representative grain images taken using an optical microscope and EBSD. FIG. 8A and FIG. 8C represent the standard billet, while FIG. 8B and FIG. 8D represent the stirred billet. FIG. 8A and FIG. 8C are optical micrographs generated using Barker's reagent. FIG. 8B and FIG. 8D are EBSD maps. These images indicate an apparent grain refinement associated with the stirred billet as well as the slight change in grain morphology. Grain area and perimeter results were also used to calculate circularity of grains, the results of which are shown in FIG. 9A and FIG. 9B.

Discussion

One observation made is the increase in zinc penetration into the mushy zone. Infiltration by a eutectic forming element can locally melt dendrites, thereby artificially increasing the permeation distance. This is especially relevant to investigations on the hot cracking sensitivity of various alloys, as the formation of low melting point eutectics is a function of alloy content. In the case of the experiments described in this example, the alloy composition remained consistent, and thus any remelting or increased permeability due to the zinc infiltration would likely be identical for both cases.

As the mushy zone of a solidifying alloy can be treated as a packed bed of media, the Kozeny-Carman relation (equation (2)) can be employed.

$$\frac{\Delta p}{L} = \frac{-180\mu}{\varphi_s^2 D_p^2} \frac{(1-\epsilon)^2}{\epsilon^3} v_s \tag{2}$$

Valid for laminar flow (typical for interdendritic feeding), the relation relates the pressure drop associated with flow through a bed of solids. In this representation, $\Delta p$ is the pressure drop, L is the length (height) of the bed, $\mu$ is the viscosity of the feeding fluid, $\varphi_s$ is the sphericity of the media, $D_p$ is the grain (particle) diameter, $\in$ is the porosity (void fraction) of the bed, and $v_s$ is the superficial velocity. This example utilizes the grain size instead of the dendrite arm spacing (DAS) as the length parameter as commercial aluminum alloys are typically grain refined and thus exhibit an equiaxed microstructure. The available pressure for feeding is given by the metallostatic pressure head within the sump, and thus the available flow distance becomes a function of the media size and shape. In the case of DC casting, this means that the feeding distance within the mushy zone is a function primarily of the size and shape of the grains within the mushy zone.

Given that both billets generated equiaxed grains, the local length parameter for the Kozeny-Carman equation (equation (2)) should be the relative grain size. With the inverse square relationship to grain size, the finer grained stirred billet should have exhibited less permeability than its coarser grained twin. The relative shape factor of the grains may be responsible for this seeming discrepancy. While grain size, or dendrite arm spacing is a simple relation to relate microstructural components to permeability, it is not the only lever. As represented in equation (2), there are typically two length scale parameters: the grain size $D_p$ and sphericity $\varphi_s$. It has been observed that in adding stirring, the sphericity of the grains notably increases. Due to the inverse square relationship, even small changes in sphericity can lead to drastic changes in permeability. In the case of non-dentritic grains, their high sphericity should likely lead to an increase in permeability beyond simple grain refinement alone as the liquid percolation path between grains becomes much more direct.

Perhaps most worthy of note is the significant increase in casting speed attainable in the stirred billet. As the hot cracking propensity tends to limit higher casting speeds, these results are quite inspiring. The highly refined as-cast microstructure (223 μm vs 95 μm grain size) is the likely dominant factor in this increase in strength. As mentioned previously, and described by a full thermodynamic model, the ratio between the grain boundary energy and the solid-liquid interfacial energy may determine the thickness of the liquid films, driven by "attractive" or "repulsive" surface energy balances. This means that all of the grain boundaries are not liquid, only a few. This means that pores, voids, or tears may nucleate within a few delocalized regions throughout the mushy zone. As the microstructure is refined, the necessary curvature or "overpressure" to be overcome for a void nucleation event increases dramatically which then increases the required stress to nucleate a tear.

CONCLUSION

Through the addition of a stirrer, it is demonstrated that the convection generated in the casting leads to a decrease in hot cracking. This decrease is believed to be due to the increased permeability exhibited by the semi-solid mush, in addition to significant grain refinement. Although convection can refine microstructures, the increased permeability may be due to the change in morphology of the grains (grain envelope) to a more spherical (globular) shape. This shift in morphology leads to a more direct percolation path through the mush, and thus an increased permeability for a given metallostatic pressure head.

ILLUSTRATIONS

As used below, any reference to a series of illustrations is to be understood as a reference to each of those examples disjunctively (e.g., "Illustrations 1-4" is to be understood as "Illustrations 1, 2, 3, or 4").

Illustration 1 is a method for forming an aluminum product, the method comprising: feeding an aluminum alloy in a molten state into a casting cavity to form an intermediate product, wherein the intermediate product comprises: a first zone having a first temperature below a liquidus temperature of the aluminum alloy and above a coherency temperature of the aluminum alloy; a second zone adjacent to the first zone, the second zone having a second temperature below or about the coherency temperature of the aluminum alloy and above a solidus temperature of the aluminum alloy; and a third zone adjacent the second zone, the third zone having a third temperature below or about the solidus temperature; and forcing convection in at least the first zone to limit a temperature variation across the first zone; wherein: grains of the third zone of the intermediate product have an average circularity from 0.5 to 1.

Illustration 2 is the method of any previous or subsequent illustration, wherein the average circularity of the grains of the third zone of the intermediate product ranges from 0.6 to 1.

Illustration 3 is the method of any previous or subsequent illustration, wherein the temperature variation across the first zone is less than 10° C.

Illustration 4 is the method of any previous or subsequent illustration, wherein the temperature variation across the first zone is less than 2% of the liquidus temperature of the aluminum alloy.

Illustration 5 is the method of any previous or subsequent illustration, wherein the third zone contains no defects due to hot cracking.

Illustration 6 is the method of any previous or subsequent illustration, wherein the first temperature is uniform within the first zone of the intermediate product.

Illustration 7 is the method of any previous or subsequent illustration, wherein the first temperature ranges from 10° C. below the liquidus temperature of the aluminum alloy to 1° C. below the liquidus temperature of the aluminum alloy.

Illustration 8 is the method of any previous or subsequent illustration, wherein the first temperature ranges from 540° C. to 660° C. or from 540±10° C. to 660±10° C.

Illustration 9 is the method of any previous or subsequent illustration, further comprising adjusting a rate of the forced convection in at least the first zone to achieve a target material property in the third zone.

Illustration 10 is the method of any previous or subsequent illustration, wherein the target material property is one or more of an average grain size in the third zone or the average circularity of grains in the third zone.

Illustration 11 is the method of any previous or subsequent illustration, further comprising adjusting a rate of the forced convection in at least the first zone to achieve a target value of the first temperature.

Illustration 12 is the method of any previous or subsequent illustration, wherein the first zone of the intermediate product comprises seed grains of the aluminum alloy having a first average size.

Illustration 13 is the method of any previous or subsequent illustration, wherein the first average size is from 10 μm to 50 μm.

Illustration 14 is the method of any previous or subsequent illustration, wherein the second zone of the intermediate product comprises grains of the aluminum alloy having a second average size, and wherein the second average size is greater than the first average size.

Illustration 15 is the method of any previous or subsequent illustration, wherein the third zone of the intermediate product comprises grains of the aluminum alloy having a third average size, and wherein the third average size is greater than the second average size.

Illustration 16 is the method of any previous or subsequent illustration, wherein the third average size from 20 μm to 120 μm.

Illustration 17 is the method of any previous or subsequent illustration, further comprising feeding the molten aluminum alloy into the second zone of the intermediate product to fill interstitial spaces among grains of the aluminum alloy in the second zone of the intermediate product.

Illustration 18 is the method of any previous or subsequent illustration, further comprising cooling at least the third zone.

Illustration 19 is the method of any previous or subsequent illustration, wherein the third zone of the intermediate product is separated from the first zone of the intermediate product.

Illustration 20 is the method of any previous or subsequent illustration, wherein the second zone of the intermediate product is disposed between the first zone of the intermediate product and the third zone.

Illustration 21 is the method of any previous or subsequent illustration, wherein the second zone of the intermediate product is disposed vertically between the first zone of the intermediate product the third zone.

Illustration 22 is the method of any previous or subsequent illustration, wherein the second zone of the intermediate product is disposed horizontally between the first zone of the intermediate product the third zone.

Illustration 23 is the method of any previous or subsequent illustration, wherein the method comprises a direct chill casting method.

Illustration 24 is the method of any previous or subsequent illustration, wherein the method comprises a continuous casting method.

Illustration 25 is the method of any previous or subsequent illustration, wherein forcing convection comprises stirring the first zone of the intermediate product.

Illustration 26 is the method of any previous or subsequent illustration, wherein the first zone of the intermediate product is stirred by an ultrasonic stirrer.

Illustration 27 is the method of any previous or subsequent illustration, wherein the first zone of the intermediate product is stirred by a mechanical stirrer.

Illustration 28 is the method of any previous or subsequent illustration, wherein the mechanical stirrer comprises a paddle or propeller.

Illustration 29 is the method of any previous or subsequent illustration, wherein the paddle or propeller comprises at least one of aluminum oxide, aluminum nitride, or graphite.

Illustration 30 is the method of any previous or subsequent illustration, wherein a cooling speed ranging from 1° C./second to 10° C./second is maintained.

Illustration 31 is the method of any previous or subsequent illustration, wherein a cooling speed ranging from 10° C./second to 100° C./second is maintained.

Illustration 32 is the method of any previous or subsequent illustration, wherein a cooling speed ranging from 100° C./second to 800° C./second is maintained.

Illustration 33 is a cast aluminum alloy product generated using the method of any previous illustration.

Illustration 34 is the cast aluminum alloy product of any previous or subsequent illustration, wherein the cast aluminum alloy product is an ingot.

Illustration 35 is the cast aluminum alloy product of any previous or subsequent illustration, wherein the cast aluminum alloy product is a continuously cast product.

Illustration 36 is a rolled aluminum alloy product generated by rolling the cast aluminum alloy product of any previous illustration.

All patents, publications and abstracts cited above are incorporated herein by reference in their entirety. The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A method comprising feeding an aluminum alloy in a molten state into a casting cavity to form an intermediate product, wherein the intermediate product comprises:

a first zone having a first temperature below a liquidus temperature of the aluminum alloy and above a coherency temperature of the aluminum alloy;

a second zone adjacent to the first zone, the second zone having a second temperature below the coherency temperature of the aluminum alloy and above a solidus temperature of the aluminum alloy; and a third zone adjacent the second zone, the third zone having a third temperature below the solidus temperature; and forcing convection in at least the first zone to limit a temperature variation across the first zone;

wherein:

grains of the third zone of the intermediate product have an average circularity from 0.5 to 1.

2. The method of claim 1, wherein the average circularity of the grains of the third zone of the intermediate product ranges from 0.6 to 1.

3. The method of claim 1, wherein the third zone contains no defects due to hot cracking.

4. The method of claim 1, wherein the temperature variation across the first zone is less than 2% of the liquidus temperature of the aluminum alloy.

5. The method of claim 1, wherein the first temperature ranges from 10° C. below the liquidus temperature of the aluminum alloy to 1° C. below the liquidus temperature of the aluminum alloy.

6. The method of claim 1, wherein the first temperature is uniform within the first zone of the intermediate product.

7. The method of claim 1, further comprising adjusting a rate of the forced convection in at least the first zone to achieve a target material property in the third zone, wherein the target material property is one or more of an average grain size in the third zone or the average circularity of grains in the third zone.

8. The method of claim 1, wherein the first zone of the intermediate product comprises seed grains of the aluminum alloy having a first average size ranging from 10 μm to 50 μm.

9. The method of claim 1, wherein the first zone of the intermediate product comprises seed grains of the aluminum alloy having a first average size, wherein the second zone of the intermediate product comprises grains of the aluminum alloy having a second average size, wherein the third zone of the intermediate product comprises grains of the aluminum alloy having a third average size, and wherein at least one of the second average size or the third average size is greater than the first average size.

10. The method of claim 1, wherein the third zone of the intermediate product comprises grains of the aluminum alloy having an average size from 20 μm to 120 μm.

11. The method of claim 1, further comprising feeding the molten aluminum alloy into the second zone of the intermediate product to fill interstitial spaces among grains of the aluminum alloy in the second zone of the intermediate product.

12. The method of claim 1, wherein the third zone of the intermediate product is separated from the first zone of the intermediate product by the second zone of the intermediate product.

13. The method of claim 1, wherein the second zone of the intermediate product is disposed vertically between the first zone of the intermediate product the third zone.

14. The method of claim 1, wherein the second zone of the intermediate product is disposed horizontally between the first zone of the intermediate product the third zone.

15. The method of claim 1, wherein forcing convection comprises stirring the first zone of the intermediate product.

16. The method of claim 15, wherein the first zone of the intermediate product is stirred by at least one of an ultrasonic stirrer, a mechanical stirrer, or a propeller.

17. The method of claim 16, wherein the propeller comprises at least one of aluminum oxide, aluminum nitride, or graphite.

18. The method of claim 1, wherein a cooling speed ranging from 1° C./second to 10° C./second is maintained.

19. The method of claim 1, wherein a cooling speed ranging from 10° C./second to 100° C./second is maintained.

20. The method of claim 1, wherein a cooling speed ranging from 100° C./second to 800° C./second is maintained.

* * * * *